US009131539B2

(12) United States Patent
Fujinami et al.

(10) Patent No.: US 9,131,539 B2
(45) Date of Patent: Sep. 8, 2015

(54) INDUCTIVE HEATING APPARATUS

(75) Inventors: Tomoya Fujinami, Shiga (JP); Masafumi Sadahira, Shiga (JP); Naoaki Ishimaru, Shiga (JP); Izuo Hirota, Hyogo (JP); Takahiro Miyauchi, Hyogo (JP); Fumitaka Ogasawara, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 727 days.

(21) Appl. No.: 13/143,882

(22) PCT Filed: Dec. 28, 2009

(86) PCT No.: PCT/JP2009/007334

§ 371 (c)(1),
(2), (4) Date: Sep. 6, 2011

(87) PCT Pub. No.: WO2010/079583

PCT Pub. Date: Jul. 15, 2010

(65) Prior Publication Data

US 2011/0309069 A1 Dec. 22, 2011

(30) Foreign Application Priority Data

| | | |
|---|---|---|
| Jan. 9, 2009 | (JP) | 2009-003222 |
| Jan. 9, 2009 | (JP) | 2009-003223 |
| May 8, 2009 | (JP) | 2009-113264 |
| May 20, 2009 | (JP) | 2009-121661 |
| Oct. 23, 2009 | (JP) | 2009-244006 |

(51) Int. Cl.
*H05B 6/12* (2006.01)
*H05B 6/06* (2006.01)

(52) U.S. Cl.
CPC ..... *H05B 6/1209* (2013.01); *H05B 6/062* (2013.01)

(58) Field of Classification Search
CPC ... F24C 15/105; F24C 15/106; H05B 1/0266; H05B 3/746; H05B 3/748; H05B 6/06; H05B 6/062; H05B 6/065; H05B 6/08; H05B 2213/04; H05B 2213/05; H05B 2213/06; H05B 2213/07; Y02B 40/126
USPC ..... 219/446.1–448.13, 620, 624, 626, 650, 219/665
See application file for complete search history.

(56) References Cited

U.S. PATENT DOCUMENTS

| | | | | |
|---|---|---|---|---|
| 8,723,083 | B2 * | 5/2014 | Kawata et al. | 219/209 |
| 2008/0173632 | A1 * | 7/2008 | Jang et al. | 219/432 |
| 2008/0237215 | A1 * | 10/2008 | Lee et al. | 219/447.1 |

FOREIGN PATENT DOCUMENTS

| | | | |
|---|---|---|---|
| CN | 101224090 | A | 7/2008 |
| EP | 0 429 120 | A2 | 5/1991 |

(Continued)

OTHER PUBLICATIONS

English translation of International Preliminary Report on Patentability for International Application No. PCT/JP2009/007334, dated Sep. 5, 2011, 8 pages.

(Continued)

*Primary Examiner* — Dana Ross
*Assistant Examiner* — Brandon Harvey
(74) *Attorney, Agent, or Firm* — Brinks Gilson & Lione

(57) ABSTRACT

Disclosed is an induction cooking device that is not likely to be affected by induction heating and wherein boiling-over can be detected. An induction cooking device has: a top plate on which a cooking container is placed; a heating coil that generates an induction magnetic field for heating the cooking container; a heating control unit that controls the heating power of the cooking container by controlling the high-frequency current supplied to the heating coil; electrodes disposed in a lower surface of the top plate; and an electrostatic capacity detector that detects changes in electrostatic capacity occurring in the electrodes when articles to be cooked contact with the top plate. When the electrostatic capacity detector senses changes in the electrostatic capacity of the electrodes, the heating control unit decreases or stops the heating power of the cooking container, and the electrodes are disposed outside of the outer circumference the heating coil.

19 Claims, 26 Drawing Sheets

(56) References Cited

FOREIGN PATENT DOCUMENTS

| | | | | |
|---|---|---|---|---|
| JP | 61-243690 | A | | 10/1986 |
| JP | 2004-171855 | A | | 6/2004 |
| JP | 2005-166392 | A | | 6/2005 |
| JP | 2005-251503 | A | | 9/2005 |
| JP | 2005-257202 | A | | 9/2005 |
| JP | 2005257202 | A | * | 9/2005 |
| JP | 2007-220388 | A | | 8/2007 |
| JP | 2008-159494 | A | | 7/2008 |
| JP | 2008159494 | A | * | 7/2008 |

OTHER PUBLICATIONS

International Search Report for International Application No. PCT/JP2009/007334, dated Apr. 6, 2010, 2 pages.

Supplementary European Search Report in corresponding European Application No. 09 83 7472, dated Jan. 7, 2014, 6 pages.

European Office Action, dated Apr. 23, 2015, pp. 1-6, issued in European Patent Application No. 09837472.1, European Patent Office, Munich, Germany.

* cited by examiner (a) DETECTION WHEN THE DIAMETER OF THE OBJECT TO BE HEATED IS SMALLER THAN THAT OF THE ELECTRODE (b) DETECTION WHEN THE DIAMETER OF THE OBJECT TO BE HEATED IS AS SAME AS THAT OF THE ELECTRODE (c) DETECTION WHEN THE DIAMETER OF THE OBJECT TO BE HEATED IS LARGER THAN THAT OF THE ELECTRODE (a)

(b)

INDUCTIVE HEATING APPARATUS

This application is a 371 application of PCT/JP2009/007334 having an international filing date of Dec. 28, 2009, which claims priority to JP2009-003222 filed Jan. 9, 2009, JP2009-003223 filed Jan. 9, 2009, JP2009-113264 filed May 8, 2009, JP2009-121661 filed May 20, 2009, and JP2009-244006 filed Oct. 23, 2009, the entire contents of which are incorporated herein by reference.

TECHNICAL FIELD

The present invention relates to an induction cooking device for heating an object to be heated by utilizing induction heating.

Background Art

When a pan not covered with a lid is heated, articles to be cooked may splash out of the pan due to boiling. Accordingly, in a conventional induction cooking device, electrodes are scattered and disposed in a lower surface of a top plate in order to observe changes in electrostatic capacity. This induction cooking device senses changes in electrostatic capacity when foods boiling over the cooking container cover the electrodes disposed on the lower surface of the top plate, and thereby detects boiling-over, and controls heating (see, for example, patent literature 1).

Patent Document 1: JP 2008-159494 A

DISCLOSURE OF INVENTION

Problem to be Solved by Invention

When boiling-over occurs, a capacitor is formed by electrodes and boiling-over. In the case of a configuration for detecting the electrostatic capacity of the electrodes by a resistance division, the detected values vary depending on the capacitor. As a result, occurrence of boiling-over can be sensed. However, in the case of induction heating as in the conventional induction cooking device in patent literature 1, the detected value may be changed due to effects of an electric field generated by induction heating, and occurrence of boiling-over may not be sensed correctly.

The present invention is intended to solve the conventional problem, and it is an object thereof to present an induction cooking device capable of detecting boiling-over correctly by resisting effects of induction heating as much as possible.

Means for Solving Problem

The induction cooking device of the present invention includes a top plate on which a cooking container is placed, a heating coil for generating an induction magnetic field for heating the cooking container, a heating control unit for controlling the heating power of the cooking container by controlling the high-frequency current to be supplied to the heating coil, electrodes disposed in a lower surface of the top plate, and an electrostatic capacity detector for detecting changes in electrostatic capacity occurring in the electrodes when articles to be cooked contact with the top plate. When the electrostatic capacity detector senses changes in the electrostatic capacity of the electrodes, the heating control unit decreases or stops the heating power of the cooking container. The electrodes are disposed outside of the outer circumference of the heating coil. The thickness of the electrodes is smaller than the superficial depth determined from the operating frequency in induction heating mode.

When the outer circumference of the heating coil is nearly circular, the electrodes may be disposed along the edge of the heating coil.

When the electrodes have a fan-like arc shape, the length in the radial direction may be shorter than the length in the arc direction.

When the electrodes are a plurality of electrodes having the same area, the length of a wiring connecting between the electrodes and the electrostatic capacity detector may be nearly equal.

In case of where the electrodes are a plurality of electrodes having the same area, if the length of a wiring connecting between the electrodes and the electrostatic capacity detector is different, the threshold value when the electrostatic capacitor detector detects changes in the electrostatic capacitor of the electrodes may be set depending on the length of the wiring.

When a plurality of electrodes are provided, and the areas of the plurality of electrodes are different, the threshold value when the electrostatic capacitor detector detects changes in the electrostatic capacitor of the electrodes may be set depending on the area of each electrode.

The electrodes may be formed by printing a conductive article on the top plate.

The wiring for connecting between the electrodes and the electrostatic capacity detector may be formed by printing a conductive article on the top plate.

When the electrodes are provided in a plurality, metal parts may be also disposed near the plurality of electrodes.

The distance between the metal parts and each electrode may be nearly equal.

The metal parts may be connected to a specified potential same as in the heating control unit or the electrostatic capacity detector.

When a plurality of heating coils are provided, the electrodes may be disposed among the plurality of heating coils.

When both the electrodes and the heating coils are provided in a plurality, each electrode may be disposed among the plurality of heating coils.

When a plurality of heating coils are provided, the electrodes may be disposed nearly in the center of the plurality of heating coils.

When the induction cooking device further includes an operation unit to be manipulated by the user for indicating a heating state, the electrodes may be disposed between the center of the heating coil and the operation unit.

When a plurality of electrodes are provided, the plurality of electrodes may be disposed so that each distance between each electrode and the center of the heating coils may be different.

The heating control unit may decrease or stop the heating power of the cooking container only when the electrostatic capacity detector first detects a change in electrostatic capacity in an electrode closer to the center of the heating coil, and then detects a change in electrostatic capacity in an electrode remoter from the center of the heating coil.

The heating control unit may decrease or stop the heating power of the cooking container only when the electrostatic capacity detector detects a change in electrostatic capacity in an electrode closer to the center of the heating coil, and then detects, within a prescribed time, a change in electrostatic capacity in an electrode remoter from the center of the heating coil.

When a plurality of electrodes are provided, the heating control unit may decrease or stop the heating power of the cooking container only when the electrostatic capacity detector detects a change in electrostatic capacity in a plurality of electrodes.

When a plurality of electrodes are provided, the heating control unit may change the mode of control on the heating capacity of the cooking container, between when the electrostatic capacity detector detects a change in electrostatic capacity in a plurality of electrodes and when a change in electrostatic capacity is detected in one electrode only.

The heating control unit may increase the decrement of heating power of the cooking container when the electrostatic capacity detector detects a change in electrostatic capacity in a plurality of electrodes than when a change in electrostatic capacity is detected in one electrode only.

Advantageous Effects of Invention

According to the present invention, since the electrodes for detecting boiling-over are disposed outside of the outer circumference of the heating coils, effects of induction heating are smaller, and boiling-over can be detected more reliably.

DETAILED DESCRIPTION OF THE PREFERRED EMBODIMENTS

Hereinafter, preferred embodiments of the present invention will be specifically described while referring to the accompanying drawings. It must be noted, however, that the invention is not limited by the illustrated embodiments alone.

Preferred Embodiment 1

An induction cooking device in preferred embodiment 1 of the present invention has electrodes for detecting boiling-over disposed outside of the outer circumference of a heating coil, and has smaller effects of induction heating, and is capable of detecting boiling-over reliably.

1.1 CONFIGURATION OF INDUCTION COOKING DEVICE

Figure 1:
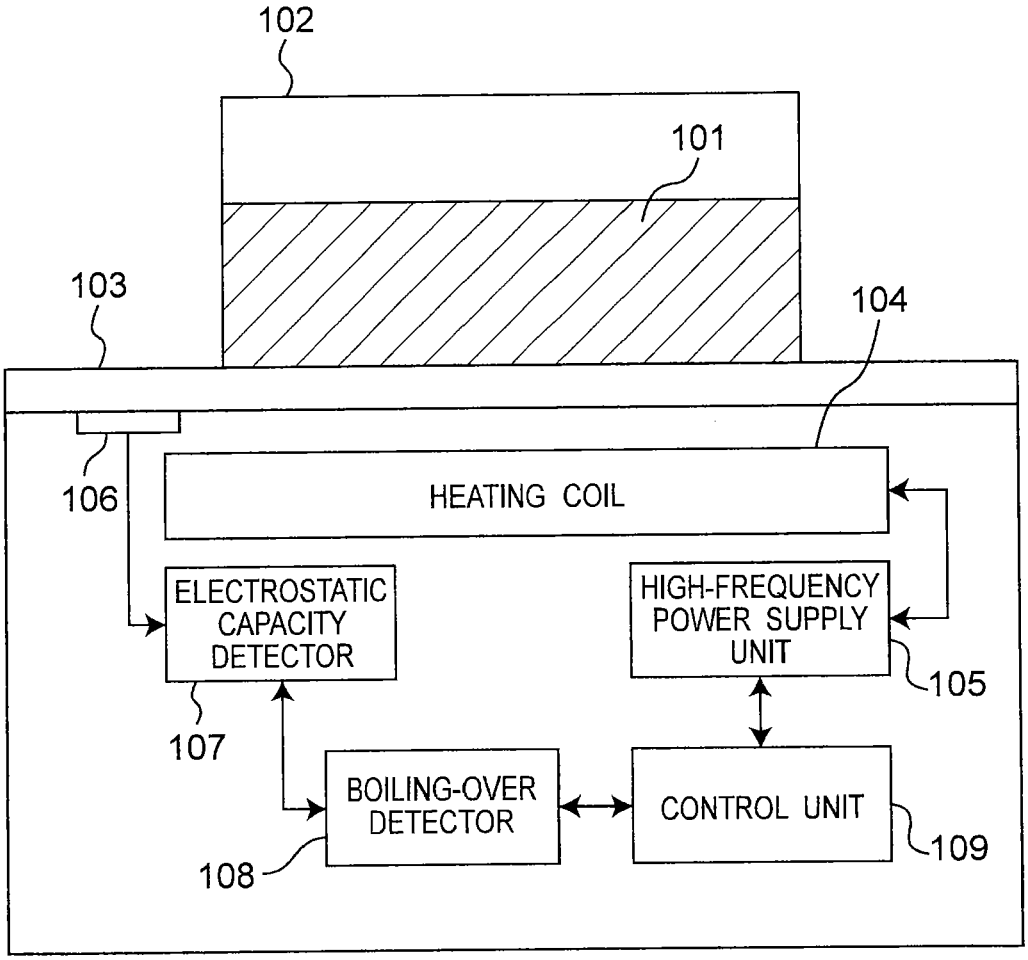
FIG. 1 is a block diagram showing a configuration of an induction cooking device in preferred embodiment 1 of the present invention.

FIG. 1 is a block diagram of an induction cooking device in preferred embodiment 1 of the present invention. The induction cooking device in preferred embodiment 1 of the invention includes a top plate 103 on which an object to be heated 102 is placed, a heating coil 104 for heating the object to be heated 102, a high-frequency power supply unit 105 for supplying a high-frequency power to the heating coil 104, an electrode 106 for detecting boiling-over, an electrostatic capacity detector 107 for detecting an electrostatic capacity generated between the electrode 106 and the boiling-over, a boiling-over detector 108 for presence or absence of boiling-over depending on the detection result of the electrostatic capacity detector 107, and a control unit 109 for controlling the entire induction cooking device.

The object to be heated 102 is, for example, a pan. The top plate 103 is, for example, crystallized glass. The high-frequency power supply part 105 is, for example, an inverter. The electrode 106 is a conductor formed on the lower surface of the top plate 103 by coating or adhering. The electrostatic capacity detector 107 is a circuit for converting the electrostatic capacity presented by the electrode 106 into a voltage. For example, the electrostatic capacity detector 107 is a configuration for detecting the electrostatic capacity presented by the electrode 106 by resistance division, in which when a capacitor due to boiling-over is connected to the resistance of a low potential side, the electrostatic capacity presented by the electrode 106 is increased, and the detected voltage value is lowered. The boiling-over detector 108 and the control unit 109 can be realized by a microcomputer.

The electrode 106 formed on the lower surface of the top plate 103 presents an electrostatic capacity through air as a dielectric element if nothing is put on the top plate 103. When the object to be heated 102 is put above the electrode 106 or an article to be cooked 101 boils over and enters between the object to be heated 102 and the electrode 106, the electrostatic capacity presented by the electrode 106 is changed. The electrostatic capacity detector 107 converts the electrostatic capacity presented by the electrode 106 sequentially into voltages, and electrostatic capacity detected values are presented to the boiling-over detector 108.

Figure 2:
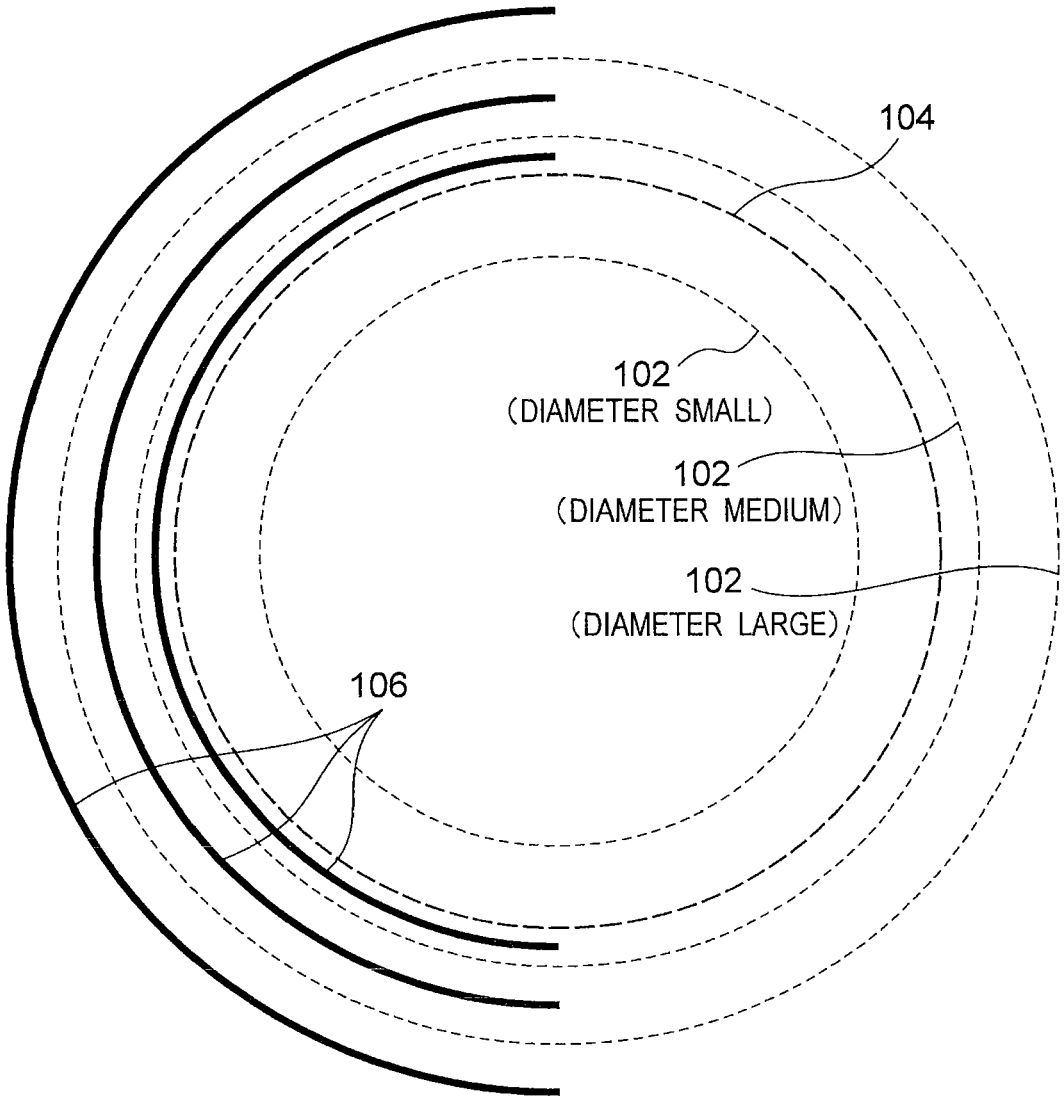
FIG. 2 is a diagram showing an example of the shape of an electrode in preferred embodiment 1 of the present invention.

FIG. 2 shows a shape of the electrode 106. In this preferred embodiment, so as to be applicable to different diameters of the object to be heated 102, a plurality of electrodes 106 of arc-shapes of different diameters are disposed on the lower surface of the top plate 103. Each electrode 106 has an arc shape, and is provided outside of the outer circumference of the heating coil 104. The electrode 106 is formed in a thinner shape than the superficial depth determined by the operating frequency when the induction cooking device operates by induction heating. When the electrode 106 is formed thinner than the superficial depth, it is possible to suppress occurrence of eddy current inside of the electrode 106 due to effects of magnetic field generated at the time of induction heating of the object to be heated 102. As a result, it is possible to suppress generation of undesired electric field which may disturb detection of changes in the electrostatic capacity due to boiling-over.

1.2 OPERATION OF INDUCTION COOKING DEVICE

Figure 3:
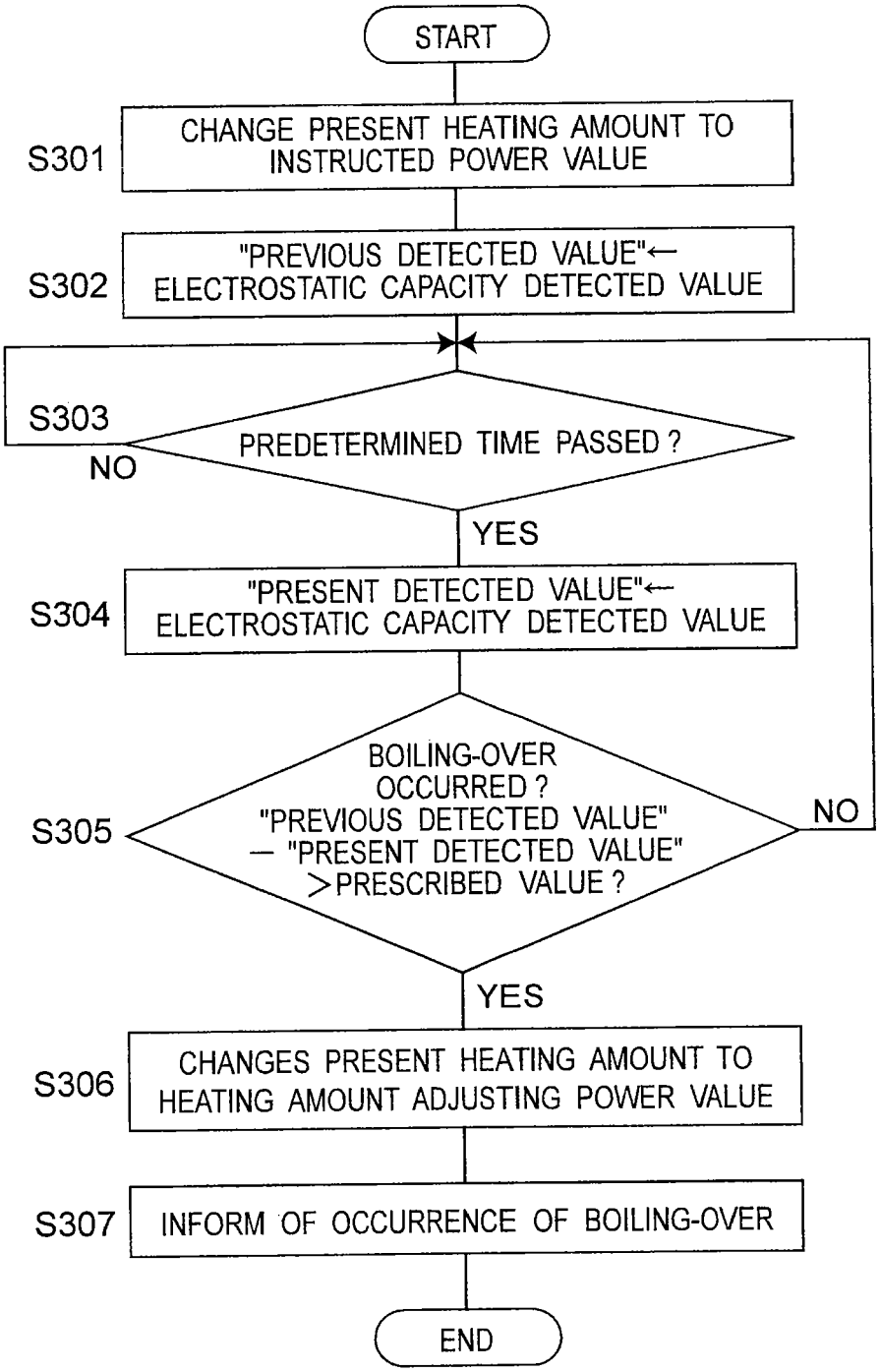
FIG. 3 is a flowchart showing a detection operation of boiling-over in preferred embodiment 1 of the present invention.

In the induction cooking device of the preferred embodiment having such configuration, the operation is specifically described below. FIG. 3 is a flowchart showing a detecting operation of boiling-over in the preferred embodiment.

The user puts the article to be cooked 101 into the object to be heated 102, and instructs start of heating to the induction cooking device of the preferred embodiment, and consequently the control unit 109 operates the high-frequency power supply unit 105, and supplies a high-frequency power into the object to be heated 102 (S301). The boiling-over detector 108 stores the electrostatic capacity of the electrode 106 upon start of heating (S302). More specifically, the electrostatic capacity detector 107 detects the electrostatic capacity of the electrode 106, and the boiling-over detector 108 assigns the electrostatic capacity detected value upon start of heating detected by the electrostatic capacity detector 107 to a "previous detected value", which is a variable for detection of boiling-over.

Afterwards, in every predetermined time (for example, 0.5 second), boiling-over detection process is executed. Specifically, the boiling-over detector 108 judges whether the predetermined time has passes or not (S303). When passing the predetermined time, the electrostatic capacity detector 107 detects the electrostatic capacity of the electrode 106, and the boiling-over detector 108 assigns the electrostatic capacity of the electrode 106 detected by the electrostatic capacity detector 107 to a "present detected value," which is a variable for detection of boiling-over (S304). The boiling-over detector 108 compares the "previous detected value" and the "present detected value" of the electrostatic capacity of the electrode 106, and judges if the difference is larger than a prescribed value (for example, 1/10 of maximum variation amount of voltage) or not (S305). If the difference is within the prescribed vale, it is judged that boiling-over has not taken place and the operation returns to step S303. If the difference is more than the prescribed vale, it is judged that boiling-over has taken place. In this case, the control unit 109 changes the present heating amount to a heating amount adjusting power (stopping or temperature maintenance power of about 500 W) (S306), and informs the user of occurrence of boiling-over (S307), and then terminates the boiling-over detection action.

Next, changes in the electrostatic capacity in the event of occurrence of boiling-over are specifically explained below by referring to FIG. 4. The electrostatic capacity is proportional to the area composing the capacity and the dielectric constant between the conductors for composing the capacity, and is inversely proportional to the distance between conductors for composing the capacity, and thereby a change occurs in the electrostatic capacity.

In the case where the object to be heated 102 is a pan of a small diameter not covered by the electrode 106, if only a small portion of the article to be cooked 101 boils over the electrode 106, the electrostatic capacity increases only very slightly. In order to observe a practical increase in the electrostatic capacity, as shown in FIG. 4 (*a*), in the electrostatic capacity formed between the object to be heated 102 and the electrode 106, it is important that a boiling-over 401 enters as a dielectric element. On the other hand, for the ease of detection of boiling-over of the pan of a small diameter, when the electrode 106 is placed above the heating coil 104, the electrostatic capacity decreases due to effects of the electric field occurring at the time of induction heating (the same action as electricity is discharged due to flow of high-frequency current when an electric field of high frequency is applied to a capacitor). Thus, it is essential that the electrode 106 should not be disposed above the heating coil 104. Besides, if the electrode 106 is disposed in the diameter direction of the heating coil 104 (see FIGS. 5 (*a*) to (*c*)), effects of the electric field on the electrode 106 are stronger when the distance to the heating coil 104 is shorter and weaker when the distance is longer, and having effects of fluctuations of the electric field, the electrostatic capacity during induction heating decreases, and increase in the electrostatic capacity cannot be observed. Therefore, the electrode 106 should be composed so that the electric field generated by induction heating should be equivalent. When the heating coil 104 is circular, the generated composite electric field is concentric, and it is required to form in an arc shape in order to avoid effects of the electric field generated at the time of induction heating.

In this manner, by forming the electrode 106 in an arc shape, effects of the electric field can be eliminated, and the area is increased in order to increase the electrostatic capacity, and further boiling-over occurring possibly from any part of the object to be heated 102 may be covered in a wide range.

Figure 4:
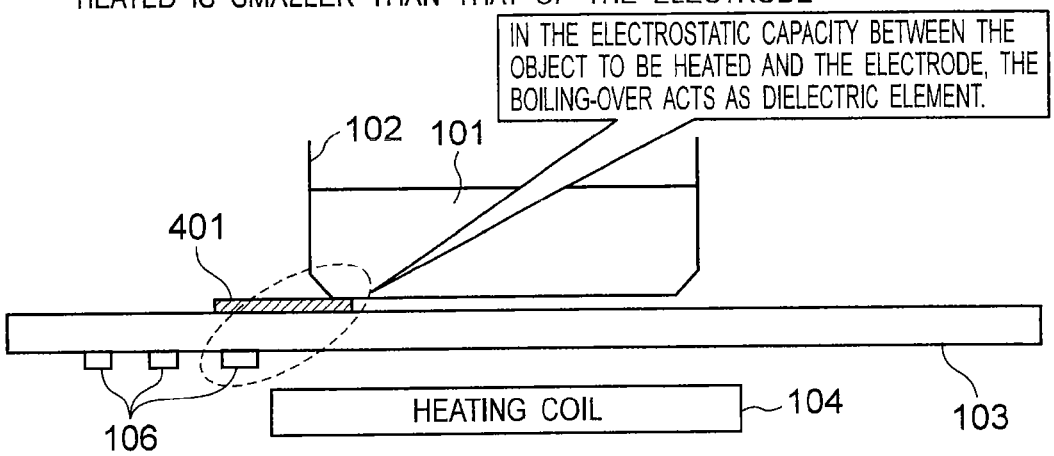
FIGS. 4(*a*)-4(*c*) are diagrams showing a state of boiling-over in preferred embodiment 1 of the present invention.
Figure 4:
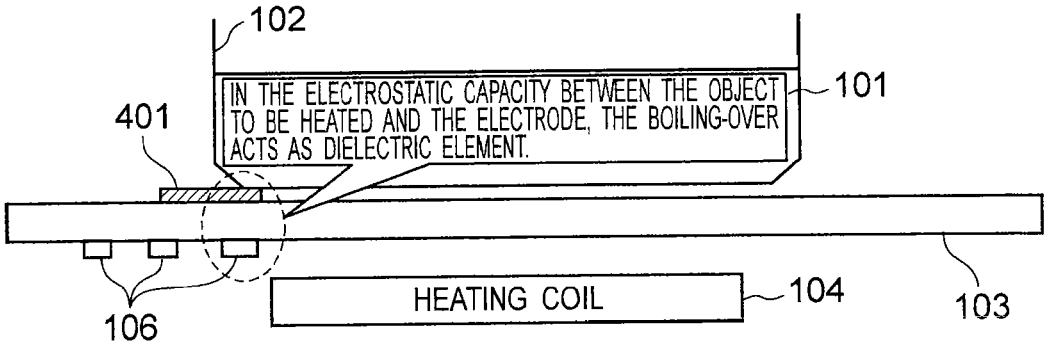
Figure 4:
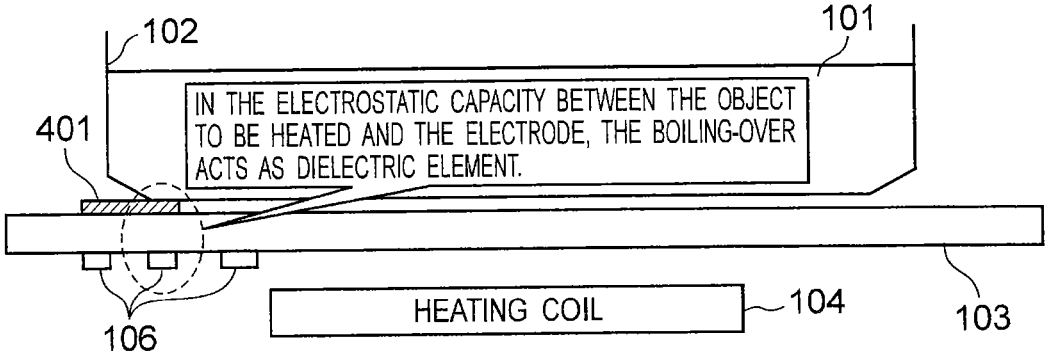

If the object to be heated 102 is a pan having a diameter large enough to overlap the electrode 106, a plurality of electrodes 106 should be provided, and it is possible to detect an increase in the electrostatic capacity at a first position where the boiling-over 401 gets into the space between the object to be heated 102 and the electrode 106 (see FIG. 4 (*b*) and FIG. 4 (*c*)).

1.3 SUMMARY

In the present embodiment, the electrode 106 is disposed outside of the outer circumference of the heating coil 104 (for example, near the outer ridge), effects of the electric field generated at the time of induction heating of the heating coil can be eliminated, and boiling-over can be detected. Moreover, when the outer circumference of the heating coil 104 is nearly circular, by disposing the electrode 106 along the direction of the electric field generated at the time of induction heating by the heating coil 104, effects of the electric field generated at the time of induction heating of the heating coil can be eliminated, and boiling-over can be detected.

In addition, by forming the electrode 106 for detecting boiling-over by using a plurality of arc-shaped electrodes, effects of induction heating can be eliminated, and an effective boiling-over detection can be realized practically. More specifically, by forming a plurality of electrodes 106 in an arc shape, it is possible to eliminate effects due to difference in the size of the object to be heated 102, and interference on electrostatic capacity due to induction heating. Still more, the boiling-over detector 107 detects changes in the electrostatic capacity formed by the electrode 106 and the object to be heated 102, occurring when the article to be cooked 101 boiling over and getting into the space between the electrode 106 and the object to be heated 102, thereby functioning as a dielectric element. As a result, the heating amount is adjusted at the time of occurrence of boiling-over. Hence, a boiling-over detecting function of high practical effect can be presented.

Figure 5:
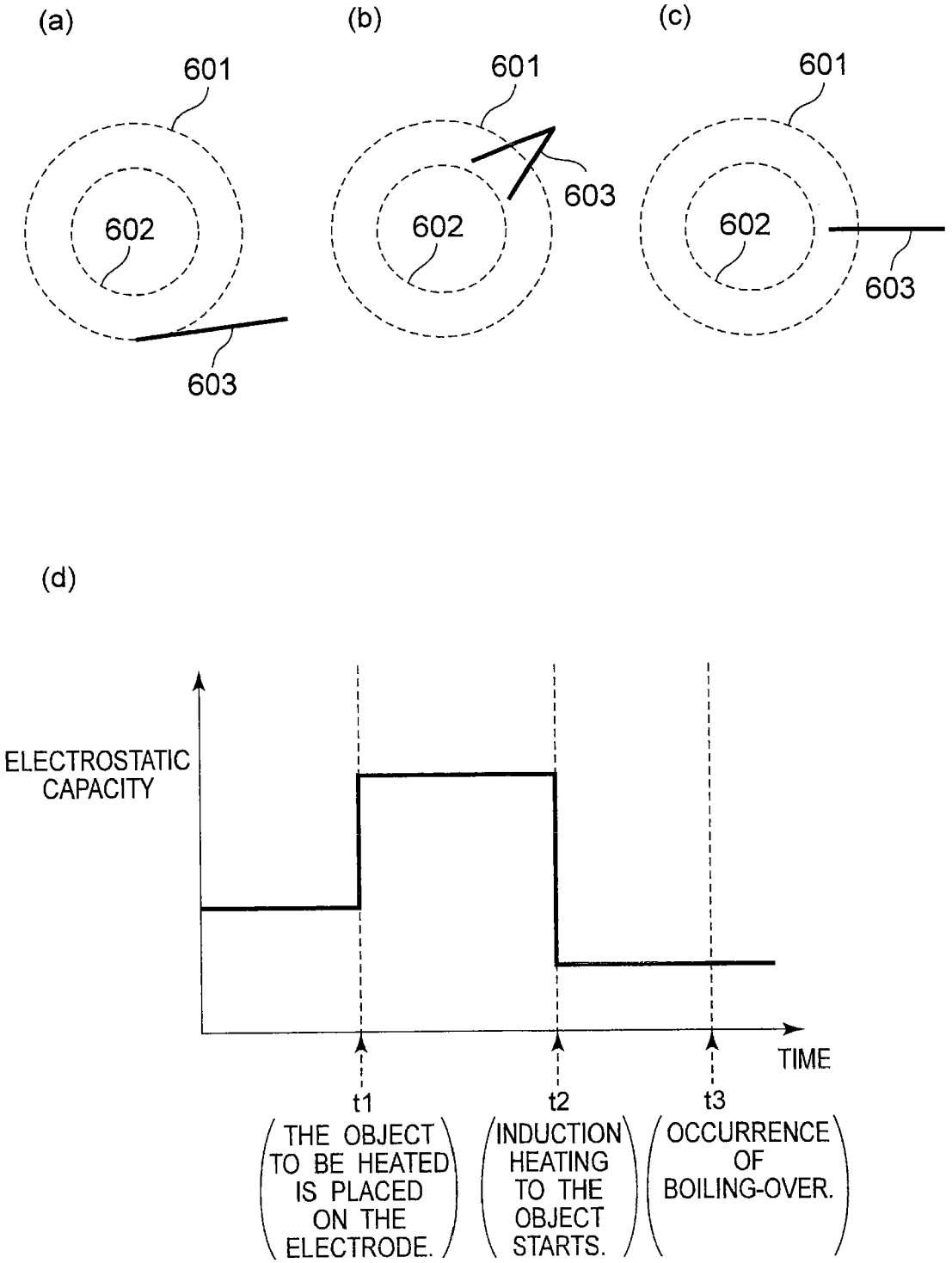
FIGS. 5(*a*)-5(*d*) are diagrams showing a shape of an electrode in a prior art in comparison with a shape of an electrode in preferred embodiment 1 of the present invention and detected values of electrostatic capacity.

Moreover, by using a simple electrode 603 having a proper length as shown in FIG. 5, when induction heating is conducted by a heating coil 602 in a state of an object to be heated 601 being overlapped and placed above the electrode 603 as shown in FIGS. 5 (*a*), (*b*), and (*c*) (time t1 in FIG. 5 (*d*)), effects of an electric field generated by induction heating by using a high-frequency power are caused, and the electrostatic capacity composed by the electrode and the object to be heated is decreased (time t2 in FIG. 5 (*d*)), and if boiling-over occurs, changes in the electrostatic capacity may not be always observed correctly (time t3 in FIG. 5 (*d*)). However, according to the preferred embodiment, since the electrode 106 is formed in an arc shape, and is disposed outside of the outer circumference of the heating coil 104, it is possible to eliminate effects of the electric field generated at the time of induction heating by the heating coil.

Still more, when the article to be cooked 101 boils over the outer circumference of the pan or the object to be heated 102, it spreads widely along the object to be heated 102, and to detect boiling-over of a certain amount, an electrode for detection having a certain length is needed. Hence, the arc shape of the electrode 106 should be formed in a length enough for detecting boiling-over of a certain amount.

In the preferred embodiment, the induction cooking device based on induction heating is explained, but detection of boiling-over by using the electrode 106 may be also applied in other cooking devices not employing induction heating, such as gas cooking devices and electric cooking devices.

1.4 MODIFIED EXAMPLES

Modified Example 1

Figure 6:
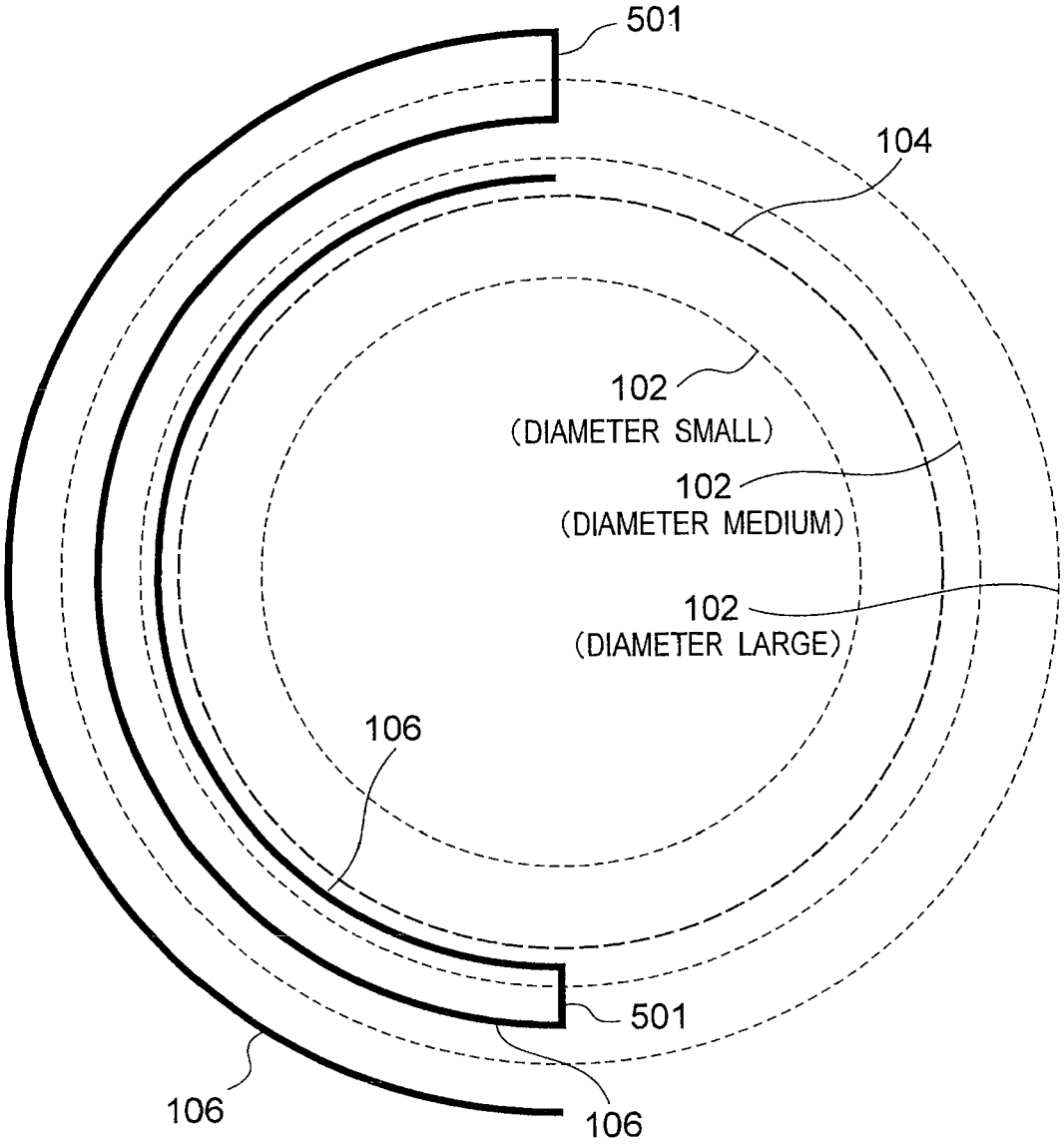
FIG. 6 is a diagram showing other example of a shape of an electrode in preferred embodiment 1 of the present invention.

In the case of induction heating by using a circular heating coil 104, as shown in FIG. 6, arc-shaped electrodes 106 may be mutually connected by an electrode 501. In the configuration of the preferred embodiment, the electrostatic capacity detectors 107 required by the same number as the plurality of electrodes 106, but in the configuration of electrodes in FIG. 6, the number of the electrostatic capacity detector 107 can be only one. Hence, without increasing the number of detection circuits used in the electrostatic capacity detectors 107, a wider detection area can be provided. In the meantime, connection portions of the arc-shaped structure are not free from effects of induction heating, and it is desired to shorten the length of the electrode 501 as much as possible. For connection of a plurality of electrodes 106 of arc-shaped structure, by connecting with electrodes 501 nearly perpendicular to the tangent of the arc, the distance exposed to effects of the electric field can be shortened, and effects on the electrodes can be suppressed. The electrodes 106 and the electrodes 501 are preferred to be formed in a thinner shape than the superficial depth determined from the operating frequency at the time of induction heating by the induction cooking device. In this manner, by connecting the plurality of electrodes 106 of arc-shaped structure differing in the radius by the electrodes 501 perpendicular to the tangent of the arc, in consideration of effects due to difference in size of the object to be heated 102 and interference to electrostatic capacity due to induction heating, a wide detection area is assured without increasing the number of detection circuits used in the electrostatic capacity detectors 107.

Modified Example 2

Figure 7:
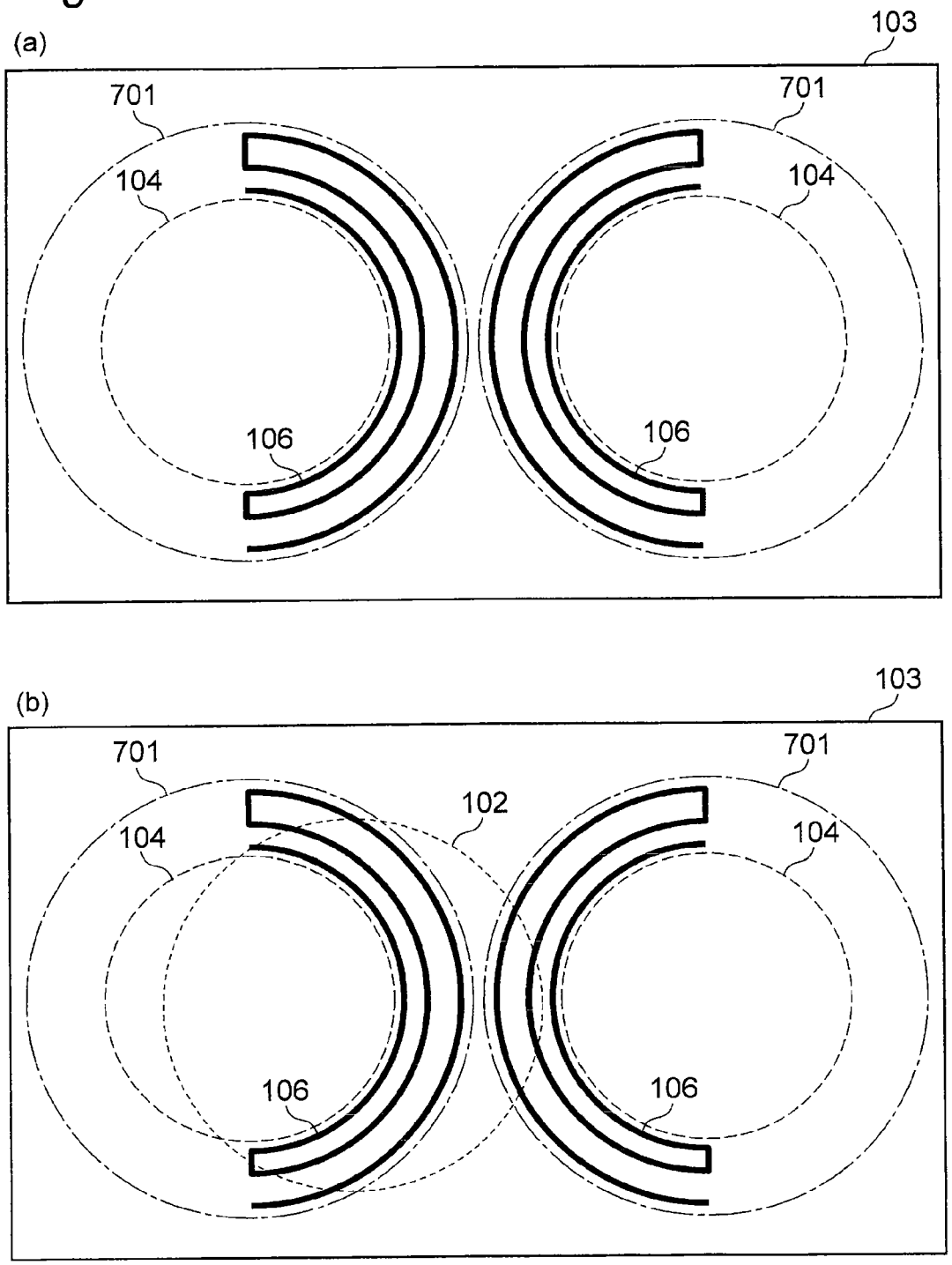
FIGS. 7(*a*) and 7(*b*) are diagrams showing an example of effective range lines in preferred embodiment 1 of the present invention.

As shown in FIGS. 7 (*a*) and (*b*), an effective range line 701 showing a detectable range of boiling-over may be indicated on the top plate 103. As a result, the installation range of the object to be heated 102 is clearly shown to the user, so that it would not happen that the object to be heated 102 is placed out of the effective range line 701, as shown in FIG. 7 (*b*). As shown in FIGS. 7 (*a*) and (*b*), moreover, when a plurality of induction heating coils 104 are disposed, if the object to be heated 102 is placed out of the effective range line 701, as explained in FIG. 5, the object to be heated 102 may be overlapped and placed on the plurality of electrodes 106. Accordingly, such situation may be avoided by presenting the effective range line 701. In this manner, by marking the effective range line 701, the detectable range of boiling-over can be clearly indicated to the user. The effective range line 701 may be also indicated by light such as LED so that it may be more clearly shown.

Modified Example 3

Figure 8:
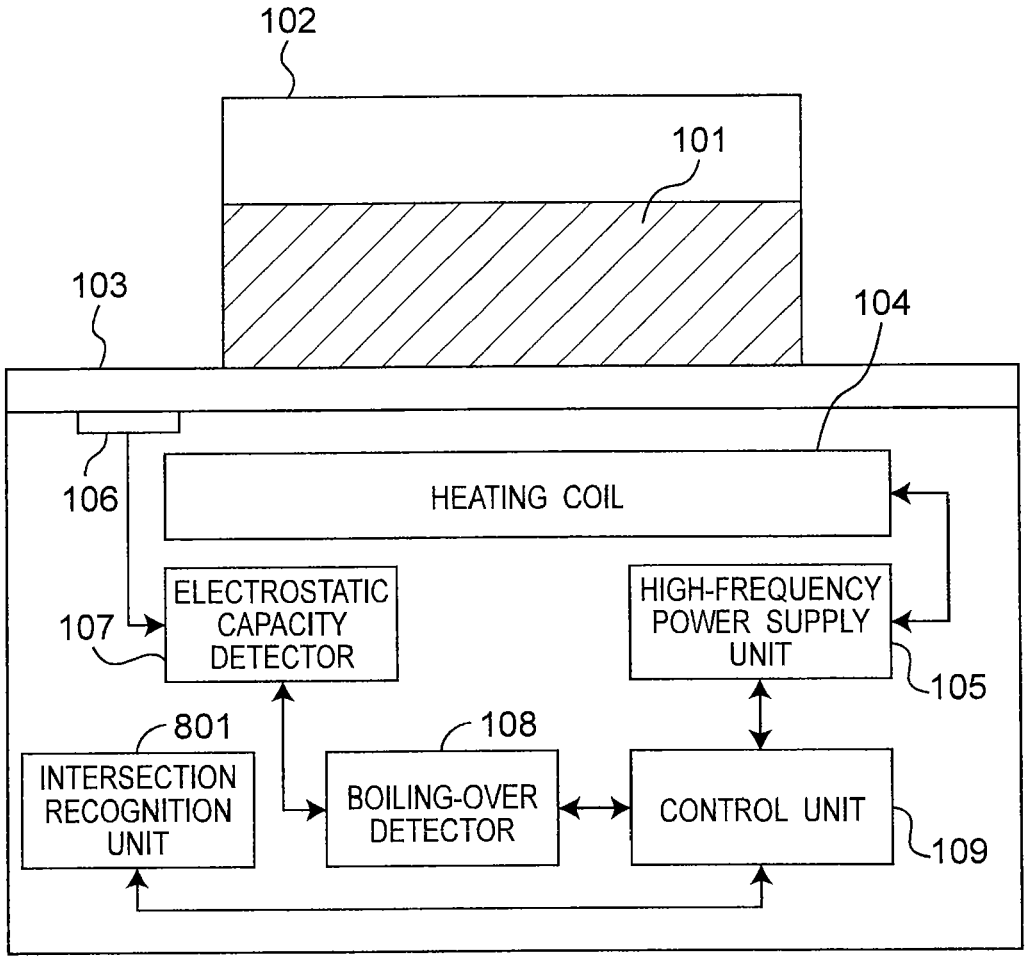
FIG. 8 is a block diagram showing other configuration of an induction cooking device in preferred embodiment 1 of the present invention.
Figure 9:
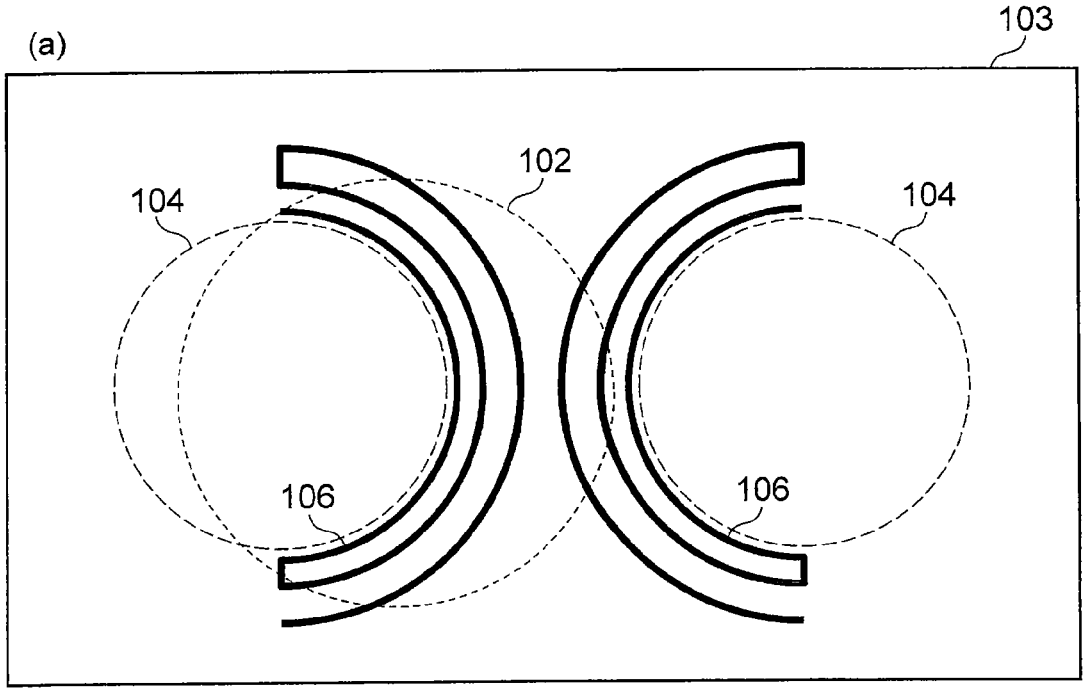
FIGS. 9(*a*) and 9(*b*) are diagrams explaining the operation of intersection confirmation in preferred embodiment 1 of the present invention.
Figure 9:
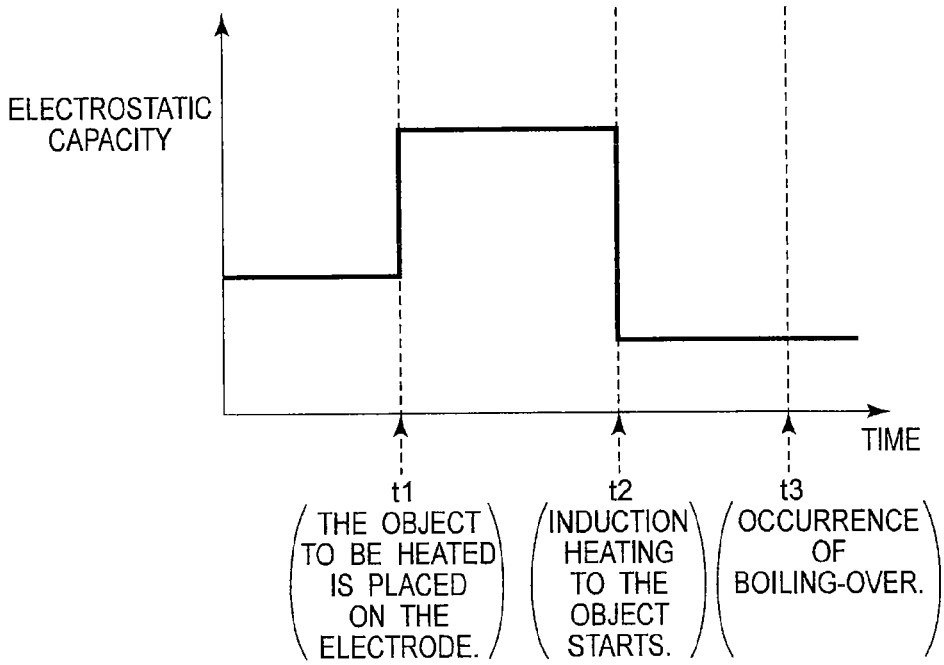

As shown in FIG. 8, an intersection recognition unit 801 for recognizing the intersection of the electrode 106 and the object to be heated 102 may be further provided. The intersection recognition unit 801 may be realized by a microcomputer. As shown in FIG. 9 (*a*), if the object to be heated 102 is overlapped and placed on the plurality of electrodes 106 (time t1 in FIG. 9 (*b*)), and induction heating is conducted by the heating coil 104, effects of the electric field generated by induction heating by high-frequency power are caused, and the electrostatic capacity composed by the electrode 106 and the object to be heated 102 may be decreased (time t2 in FIG. 9 (*b*)), and if boiling-over occurs, changes in the electrostatic capacity may not be observed (time t3 in FIG. 9 (*b*)). The intersection recognition unit 801 has a function of recognizing by monitoring the output of the electrostatic capacity detector 107, that a change occurs as shown in FIG. 9 (*b*) when induction heating is started in a state of intersecting of the electrode 106 and the object to be heated 102. The intersection recognition unit 801 recognizes the intersection of the electrode 106 and the object to be heated 102, and transmits it to the control unit 109, and then the control unit 109 informs the user to tell that the place of installation of the object to be heated 102 should be changed, or that detection of boiling-over is disabled. In this manner, by using the intersection recognition unit 801 for recognizing that the output of the electrostatic capacity detector 107 is affected by the electric field by induction heating due to intersection of the electrode 106 and the object to be heated 102, if the user attempts to put the object to be heated 102 out of the boiling-over detectable range, the user knows that boiling-over cannot be detected.

Preferred Embodiment 2

An induction cooking device in preferred embodiment 2 of the present invention is equalized in the sensing sensitivity among the electrodes so as to detect boiling-over more securely.

2.1 CONFIGURATION OF INDUCTION COOKING DEVICE

Figure 10:
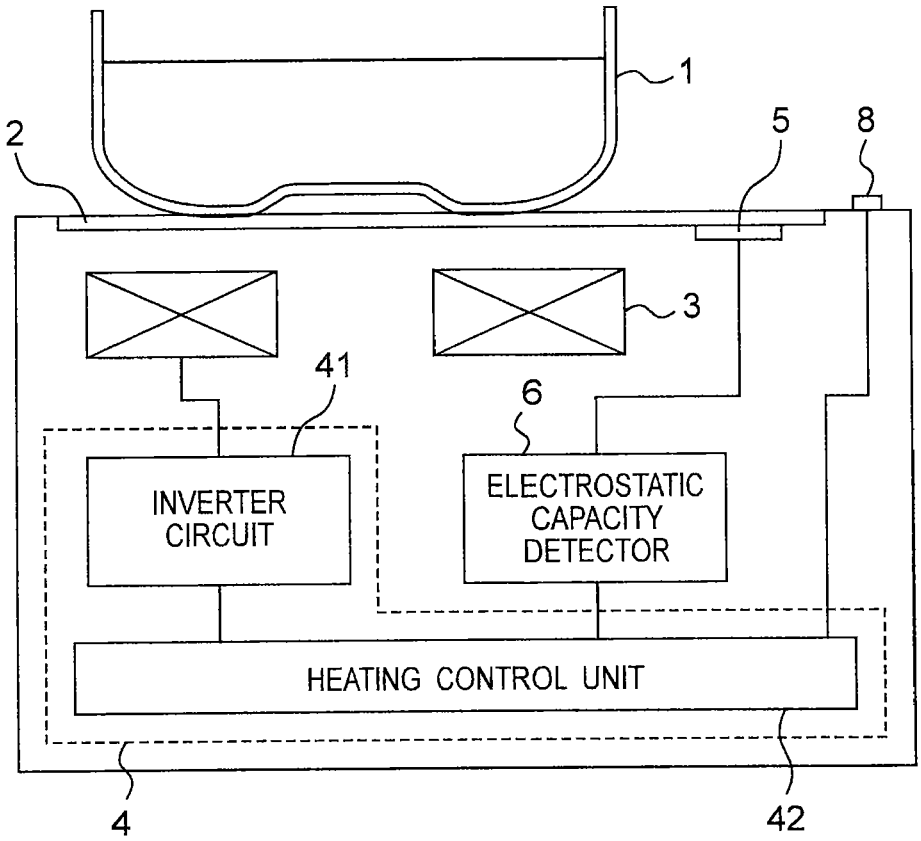
FIG. 10 is a block diagram showing a configuration of an induction cooking device in preferred embodiment 2 of the present invention.

FIG. 10 is a block diagram of an induction cooking device in preferred embodiment 2 of the present invention. The induction cooking device in this preferred embodiment includes a top plate 2 on which a cooking container 1 is placed, a heating coil 3 to generate inductive magnetic field for heating the cooking container 1, and a control unit 4 for controlling the entire induction cooking device. The control unit 4 has an inverter circuit 41 for converting an electric power from a commercial power source and supplying a high-frequency current to the heating coil 3, and a heating control unit 42 for controlling the inverter circuit 41 and controlling the heating power of the cooking container 1.

Further, the induction cooking device of this preferred embodiment also includes an electrode 5 composed on the lower surface of the top plate 2, and an electrostatic capacity detector 6 for detecting changes in the electrostatic capacity composed between the electrode 5 and other conductor. The electrostatic capacity detector 6 is connected to the heating control unit 42. The heating control unit 42 controls the inverter circuit 41 depending on the result from the electrostatic capacity detector 6, and changes the high-frequency current to be supplied to the heating coil 3, and thereby controls the heating power to the cooking container 1.

The cooking container 1 is a container in which food and article to be cooked are placed. The cooking container 1 is, for example, a stew pan, a frying pan, a kettle, or the like. The cooking container 1 can be heated by induction heating. The cooking container 1 is placed on the top plate 2 which forms a part of the outer casing of the induction cooking device. At this time, the cooking container 1 is put on a position opposite to the heating coil 3. The top plate 2 is often made of crystallized glass, but the article is not particularly limited.

The heating coil 3 receives a high-frequency current from the inverter circuit 41 operating in accordance with the instruction from the heating control unit 42, and generates a high-frequency magnetic field by this current. An eddy current is generated in the cooking container 1 receiving the high-frequency magnetic field, and this eddy current heats the cooking container 1.

The induction cooking device of this preferred embodiment further includes an operation unit 8 to be manipulated by the user of the induction cooking device for instructing the heating power and others. The operation unit 8 and the inverter circuit 41 are connected to the heating control unit 42. The heating control unit 42, for example, when the automatic cooking mode is instructed from the operation unit 8, controls the inverter circuit 41 depending on the content of the automatic cooking mode. When the user manipulates the operation unit 8 to start or stop the heating operation or to adjust the heating power, the heating control unit 42 controls the inverter circuit 41, and controls to perform a desired operation.

The electrode 5 is a conductor formed on the lower surface of the top plate 2 by coating or adhering. In this preferred embodiment, the electrode 5 is formed by printing a conductive article on the top plate 2. Any conductive article may function as an electrode, and, for example, the electrode 5 may be formed by disposing a metal plate on the lower surface of the top plate. However, since the electrostatic capacity generated in the electrode 5 is extremely small, the value of the electrostatic capacity may be changed only by a small factor. For example, the value of the electrostatic capacity is changed if a small gap is formed between the metal plate and the top plate. Accordingly, to obtain stably the value of the electrostatic capacity, it is preferred to form the electrode 5 by printing a conductive article on the backside of the top plate 2. As a result, the distance between the top plate 2 and the electrode 5 is kept constant, and the value of the electrostatic capacity is stabilized. Hence, boiling-over can be detected stably. In addition, since the assembly of the device can be simplified, the induction cooking device can be manufactured at a low cost, which brings about a benefit to the user.

A capacitor is formed between the electrode 5 and the conductor on the top plate 2. Usually, nothing is present on the top plate 2, and air plays the role of a conductor. When different objects are present on the top plate 2, including the cooking container 1, finger(s), water and articles to be cooked, since the individual specific inductive capacities is different from that of the air, the electrostatic capacity changes. The electrostatic capacity detector 6 detects these changes in the electrostatic capacity.

The electrostatic capacity detector 6 detects by converting changes in the electrostatic capacity into changes in direct-current voltage or the like. For example, the electrostatic capacity detector 6 detects the electrostatic capacity of the electrode 5 by resistance division, and when a capacitor due to boiling-over is connected to the resistance at the low potential side, in this configuration, the electrostatic capacity of the electrode 5 is increased, and the detected voltage value is lowered. The configuration of the electrostatic capacity detector 6 is not limited to the example of the preferred embodiment.

2.2 OPERATION OF INDUCTION COOKING DEVICE

In the induction cooking device of the preferred embodiment having such configuration, the operation is specifically described below.

When the user manipulates the operation unit 8 to instruct starting of heating, the heating control unit 42 operates the inverter circuit 41 to supply a high-frequency current to the heating coil 3. As a result, a high-frequency magnetic field is generated from the heating coil 3, and heating of the cooking container 1 is started.

The heating control unit 42 controls the inverter circuit 41 so as to reach a desired power set by the user by manipulating the operation unit 8. More specifically, for example, the input current of the inverter circuit 41 is detected, and the detected value is put into the heating control unit 42. The heating control unit 42 compares the power determined by the user and the input current of the inverter circuit 41, and changes the operation state of the inverter circuit 41. By repeating such operation, the heating control unit 42 controls at the power determined by the user, and operates to maintain this power.

While the cooking container 1 is being heated, if the article to be cooked in the cooking container 1 reaches the boiling point, the article to be cooked may boil over out of the cooking container 1. In such a case, if heating is continued without decreasing the heating power, the article to be cooked may continue to boil over the cooking container 1, and various problems may occur. For example, when the boiling-over article to be cooked covers the operation unit 8, the operation unit 8 becomes too hot to be manipulated. When the article to be cooked covers the intake and exhaust port of the induction cooking device, the intake and exhaust port cannot be cleaned. Further, if the article to be cooked boiling over the top plate 2 from the cooking container 1 is heated; it may stick hard to the top plate 2.

However, in the induction cooking device of the preferred embodiment, when the electrostatic capacity detector 6 detects changes in the electrostatic capacity, the heating power is decreased, or the heating is stopped. As a result, continuing of boiling-over is prevented, and the article to be cooked is prevented from being stuck to the top plate 2.

On the other hand, when realizing the induction cooking device, due to effects of the electric field generated at the time of induction heating, energy is supplied into the electrostatic capacity detector 6, and it may be impossible to detect accurately the electrostatic capacity composed between the electrode 5 and the article to be cooked originally intended to be detected. This mechanism is explained below.

Figure 11:
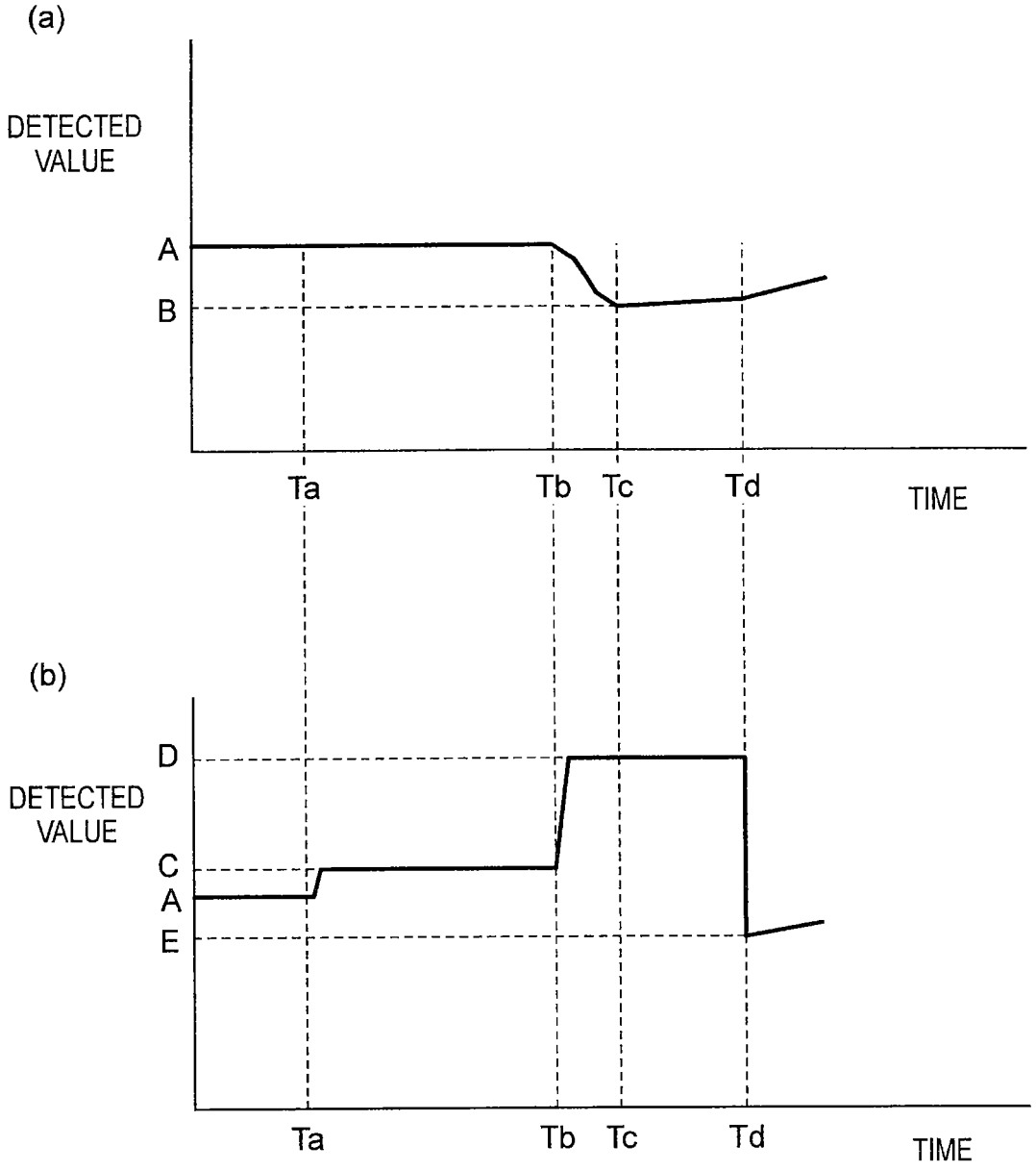
FIGS. 11(*a*) and 11(*b*) are diagrams showing detected values of an electrostatic capacity detector of the induction cooking device in preferred embodiment 2 of the present invention.

FIGS. 11 (*a*) and (*b*) show the detection results of electrostatic capacity of the electrostatic capacity detector 6 in the induction cooking device in preferred embodiment 2 of the present invention. FIGS. 11 (*a*) and (*b*) are only examples of boiling-over, and changes in the detected values may not always coincide with FIGS. 11 (*a*) and (*b*).

FIG. 11 (*a*) shows an example being free from effects of the electric field. When induction heating is started at time Ta, the detected value is maintained at value A before start of heating. At time Tb, boiling-over occurs, and when the article to be cooked covers the electrode 5, the electrostatic capacity is increased. The electrostatic capacity detector 6 observes changes in the impedance due to increase of the electrostatic capacity of the electrode 5 by the resistance potential, and hence the detected value is lowered in the electrostatic capacity detector 6 for detecting the increased electrostatic capacity. In the meantime, the configuration of the electrostatic capacity detector 6 is not limited to the example of the preferred embodiment alone. After time Tc, as the boiling-over article to be cooked moves, the covering area above the electrode 5 with the article to be cooked varies. As a result, the electrostatic capacity is changed, and the detected value of the electrostatic capacity detector 6 is changed gradually.

FIG. 11 (*b*) shows an example when being affected by the electric field. The detected value of the electrostatic capacity detector 6 elevates from detected value A before start of heating to detected value C (C>A) when induction heating is started at time Ta. This is not because detection at the electrostatic capacity detector 6 is increase as a result of decrease in the floating capacity formed in the electrode 5, but it is estimated that an energy is supplied through the electrode 5 from the electric field generated by starting of induction heating, thereby increasing the detected value of the electrostatic capacity detector 6. Boiling-over occurs at time Tb, and when the boiling-over article to be cooked covers the electrode 5, the boiling-over article to be cooked plays the role of an antenna, and the effects of the electric field become large than before boiling-over, and the detected value of the electrostatic capacity detector 6 elevates substantially to become value D (D>C). When induction heating is stopped at time Td, the detected value of the electrostatic capacity detector 6 gets free from effects of the electric field, and the detected value is only the value of the electrostatic capacity formed by the electrode 5. At this time, the article to be cooked not present before starting of heating is present and covers the electrode 5, and the electrostatic capacity is increased, and the electrostatic capacity detector 6 detects a detected value E (E<A) smaller than detected value A before start of heating.

In this manner, while being free from effects of the electric field, as shown in FIG. 11 (*a*), the detected value of the electrostatic capacity detector 6 varies exactly in relation to the changes in the electrostatic capacity generated by the electrode 5. However, under the effects of the electric field, as shown in FIG. 11 (*b*), the detected value of the electrostatic capacity detector 6 varies not only due to the electrostatic capacity generated by the electrode 5, but also due to magnitude of the energy supplied through the electrode 5 from the electric field.

Such manner of receiving effects of the electric field is determined by various factors. For example, a wiring connecting between the electrode 5 and the electrostatic capacity detector 6 plays a certain role. Effects of the electric field vary depending on the length of the wiring or the distribution thereof. For example, if the wring is distributed in a nearly circular profile, this wiring functions as a loop antenna. If the wiring is long, it is also likely to function as an antenna.

In the preferred embodiment, accordingly, the length of the wires for connecting between the electrode 5 and the electrostatic capacity detector 6 is nearly equalized. As a result, effects of the electric field are at the same level on a plurality of electrodes 5, and the boiling-over detecting condition is equal. Hence, it is possible to prevent the user from feeling differently due to difference in sensitivity on every electrode for detecting boiling-over, and the induction cooking device of high convenience of use can be presented. Examples of wiring are shown below.

2.3 EXAMPLES OF WIRING

Figure 12:
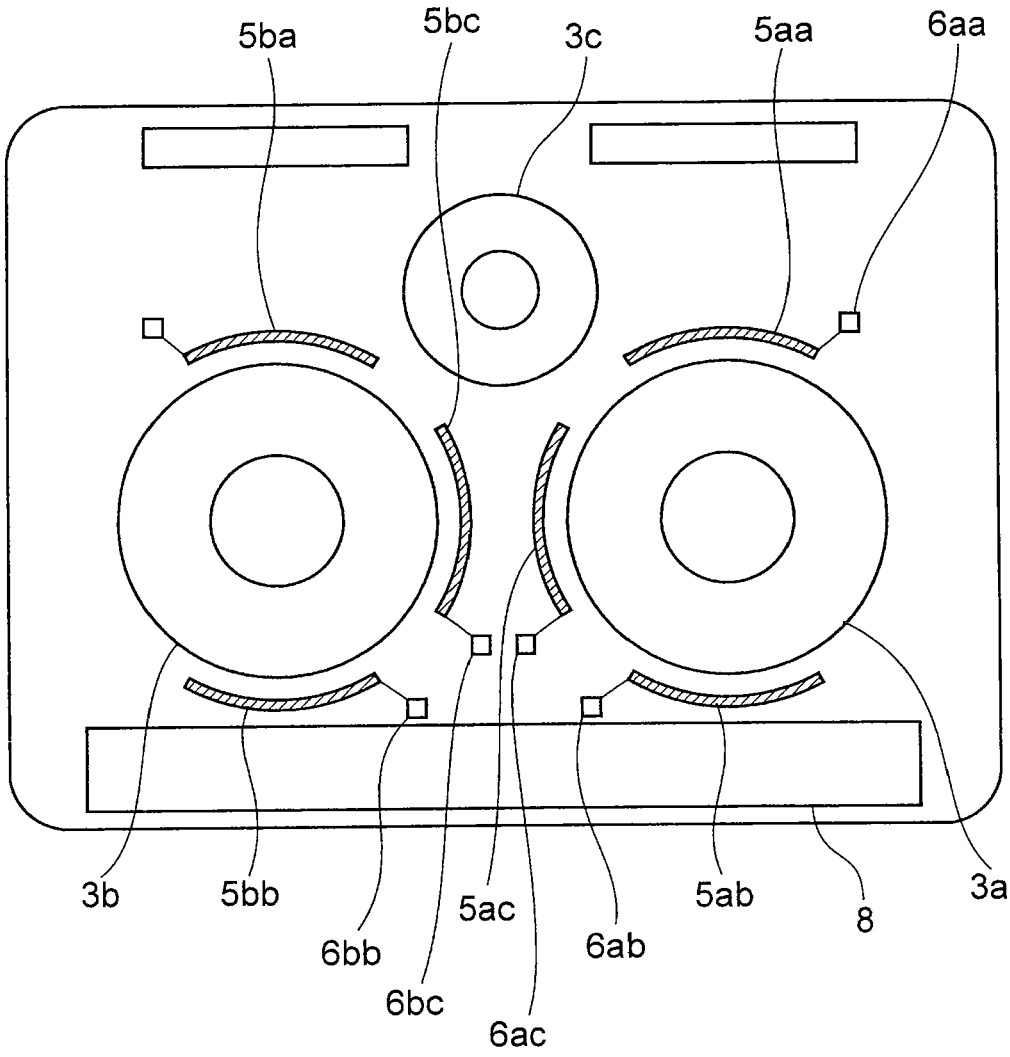
FIG. 12 is a layout diagram showing an example same in the length of a wiring for connecting between an electrode and an electrostatic capacity detector of the induction cooking device in preferred embodiment 2 of the present invention.

FIG. 12 shows a layout equalized in the length of wires for connecting between the electrode 5 and the electrostatic capacity detector 6. In FIG. 12, electrodes 5*aa*, 5*ab*, 5*ac*, and others are collectively called electrodes 5. Similarly, electrostatic capacity detectors 6*aa*, 6*ab*, 6*ac*, and others are collectively called electrostatic capacity detectors 6. In FIG. 12, in one induction heating unit (each one of heating coils 3*a* and 3*b*), three electrodes 5 (5*aa*, 5*ab*, and 5*ac*) of same area are disposed. The electrostatic capacity detectors 6 (6*aa*, 6*ab*, and 6*ac*) for detecting the electrostatic capacity of each electrode 5 are disposed at equal distance near each electrode 5. In this layout, not only the wiring length is equal among the three electrodes 5, but also the wiring length is short, effects of the electric field are less likely to be caused. However, since the electrostatic capacity detectors 6 are scattered about, the layout in the device is complicated. In addition, since the electrostatic capacity detectors 6 are composed individually, the cost is increased, and finally the induction cooking device becomes expensive.

Figure 13:
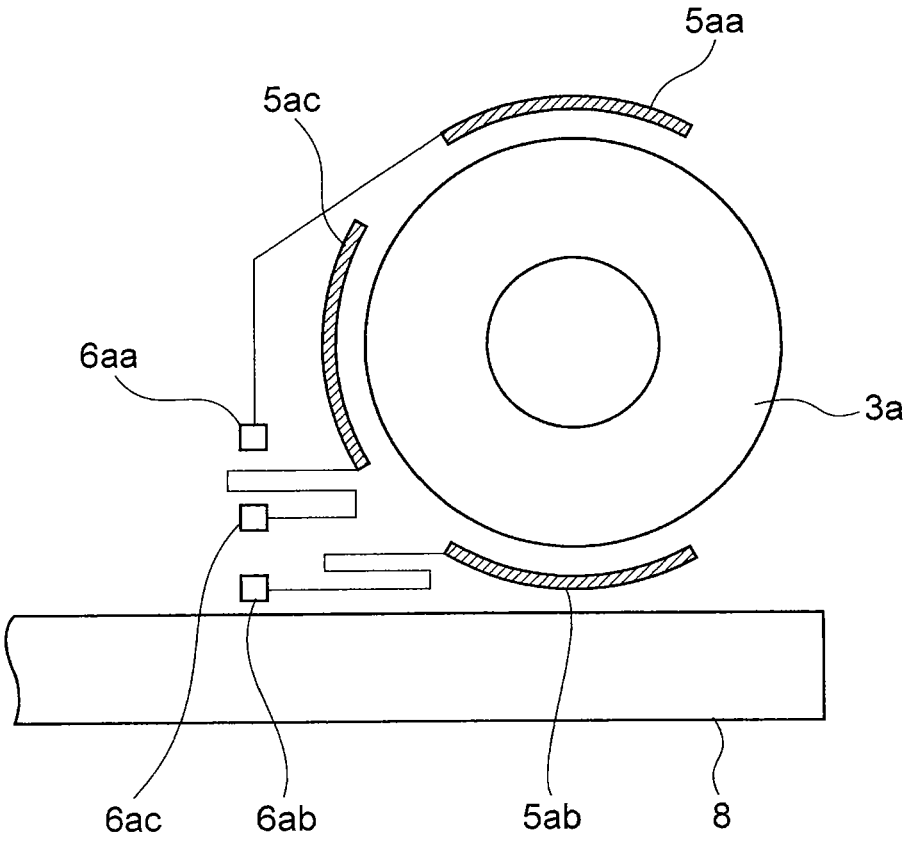
FIG. 13 is a layout diagram in which a plurality of electrostatic capacitor detectors are assembled in one place in the induction cooking device in preferred embodiment 2 of the present invention.

FIG. 13 shows a layout in which the plurality of electrostatic capacity detectors 6 (6*aa*, 6*ab*, and 6*ac*) are gathered in one place. In the meantime, FIG. 13 shows only one induction heating unit (heating coil 3*a*). In FIG. 13, the individual electrostatic capacity detectors 6 (6*aa*, 6*ab*, and 6*ac*) are disposed closely to each other. According to this installation, a plurality of electrostatic capacity detectors 6 can be gathered in one place, and the layout can be simplified inside of the device. Hence, cooling of the inside of the device is advantageous, and the induction cooking device of high reliability can be realized. In addition, since the induction cooking device can be manufactured at a low cost, and a great benefit can be presented to the user.

In the layout in FIG. 13, for example, if the electrode 5 and the electrostatic capacity detector 6 are wired at a shortest distance, effects of the electric field are received in different manners in individual electrodes, and the user may feel strange. It is hence necessary to adjust the detection sensitivity of the electrostatic capacity detector 6 in every electrode 5. However, as shown in FIG. 13, when the wiring length is adjusted to be equal on any electrode 5, effects of the electric field are received similarly in all electrodes. Therefore, in every electrode 5, the detection sensitivity of boiling-over is equal, and the induction cooking device to be used safely by the user can be realized.

In the preferred embodiment, the wires for connecting between the electrodes 5 and the electrostatic capacity detectors 6 are formed by printing a conductive article on the top plate 2. The wires for connecting between the electrodes 5 and the electrostatic capacity detectors 6 are not particularly specified as far as they are connected electrically, and vinyl coated wires, for example, may be used. However, since the electrostatic capacity occurring in the electrode 5 is very small, the electrostatic capacity may differ only due to differences of the wiring length or changes of the distribution state. In such a state, fluctuations may occur in the detection precision of boiling-over. Hence, the wiring is desired to be stable in length and distribution of wiring. In order to obtain stable values of electrostatic capacity, a conductive article is printed on the back side of the top plate 2, and the electrode 5 and the electrostatic capacity detector 6 are connected electrically. As a result, the values of the electrostatic capacity are stabilized. Thus, boiling-over can be detected stably. Besides, since the assembly of the device is simplified, the induction cooking device can be manufactured at low cost, and the user feels a benefit, and the space inside of the device can be saved.

2.4 SUMMARY

The induction cooking device of the preferred embodiment is equalized in the length of wiring connecting between the electrode 5 and the electrostatic capacity detector 6, and effects of the electric field received in each electrode 5 is same in the level. That is, the detection sensitivity of boiling-over in all electrodes is the same. In addition, the detection conditions of boiling-over (for example, threshold values) may be equal. Therefore, the user may not feel strange. The convenience of use is enhanced. If the size of the cooking container or the electrodes are changed, effects of the electric field may be felt in the same manner, and boiling-over can be detected easily.

2.5 MODIFIED EXAMPLES

Modified Example 1

Figure 14:
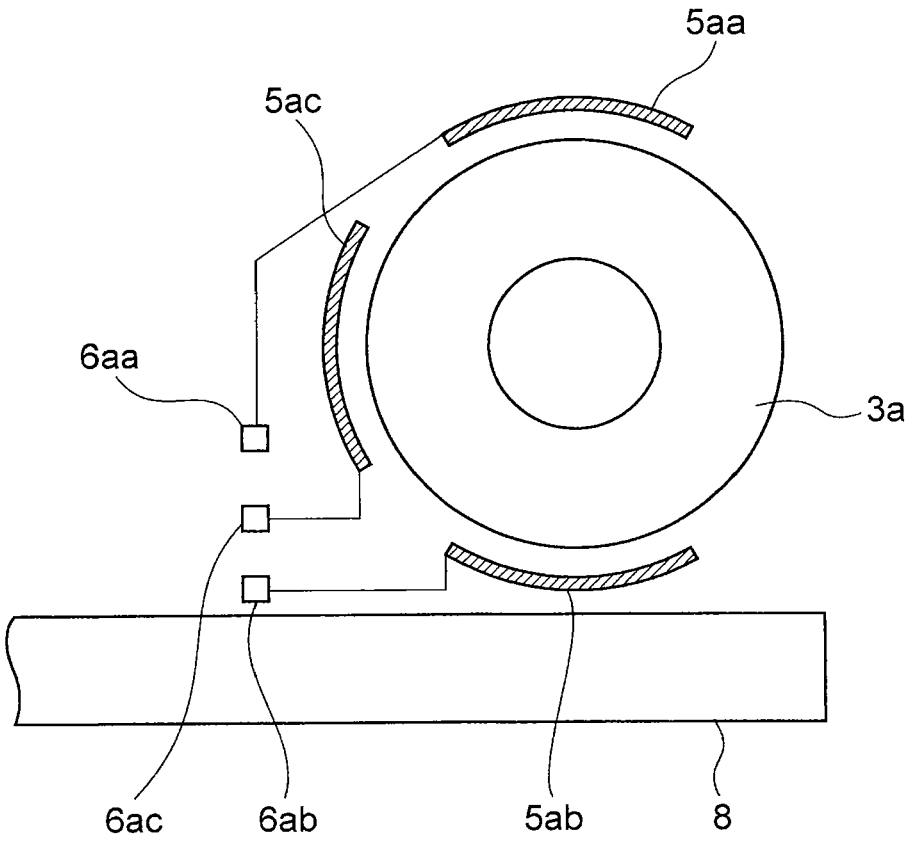
FIG. 14 is a layout diagram showing an example different in the length of a wiring for connecting between an electrode and an electrostatic capacity detector of the induction cooking device in preferred embodiment 2 of the present invention.

In this preferred embodiment, the length of wires for electrically connecting between the electrodes 5 and the electrostatic capacity detectors 6 is the same, but the length of wires may be made different. In this case, the threshold value of the electrostatic capacity detectors 6 for detecting changes in the electrostatic capacity may be set differently depending on the wiring length. FIG. 14 shows a layout diagram in which the wiring length varies for connecting between the electrodes 5 and the electrostatic capacity detectors 6 (6*aa*, 6*ab*, 6*ac* . . . ). In FIG. 14, only one heating coil 3*a* is shown.

As shown in FIG. 12, when the electrostatic capacity detectors 6 (6*aa*, 6*ab*, 6*ac* . . . ) are scattered and disposed on every electrode, and hence the wiring length can be shortened and effects of the electric field are less likely to be caused. However, since the electrostatic capacity detectors 6 are scattered, the layout is complicated in the inside of the device. In addition, the electrostatic capacity detectors 6 are composed individually, and the cost is increased, and finally the induction cooking device becomes expensive. On the other hand, when the electrostatic capacity detectors 6 (6*aa*, 6*ab*, 6*ac* . . . ) are gathered in one place as shown in FIG. 13 and FIG. 14, the layout in the inside of the device can be simplified. As a result, the manufacturing cost is saved, and the induction cooking device can be presented at a low price. In FIG. 13, the wiring length is equalized. In this case, effects of the electric field are received at the same level. In other words, the sensitivity of individual electrodes 5 is equalized. Hence, the electrostatic capacity detector 6 is same in the values of the judging threshold when detecting changes in the value of electrostatic capacity.

On the other hand, in the case of FIG. 14, the wires between the electrodes 5 (electrodes 5*aa*, 5*ab*, and 5*ac*) and the electrostatic capacity detectors 6 (6*aa*, 6*ab*, and 6*ac*) are nearly at a shortest distance, and the wiring length varies in each electrode 5. Accordingly, effects of the electric field are received differently, and the sensitivity is varied. Therefore, when the wiring length is different, the threshold values when detecting the changes in the electrostatic capacity by the electrostatic capacity detector 6 is set differently depending on the wiring length. As a result, the detection sensitivity becomes uniform among the electrodes 5.

Figure 15:
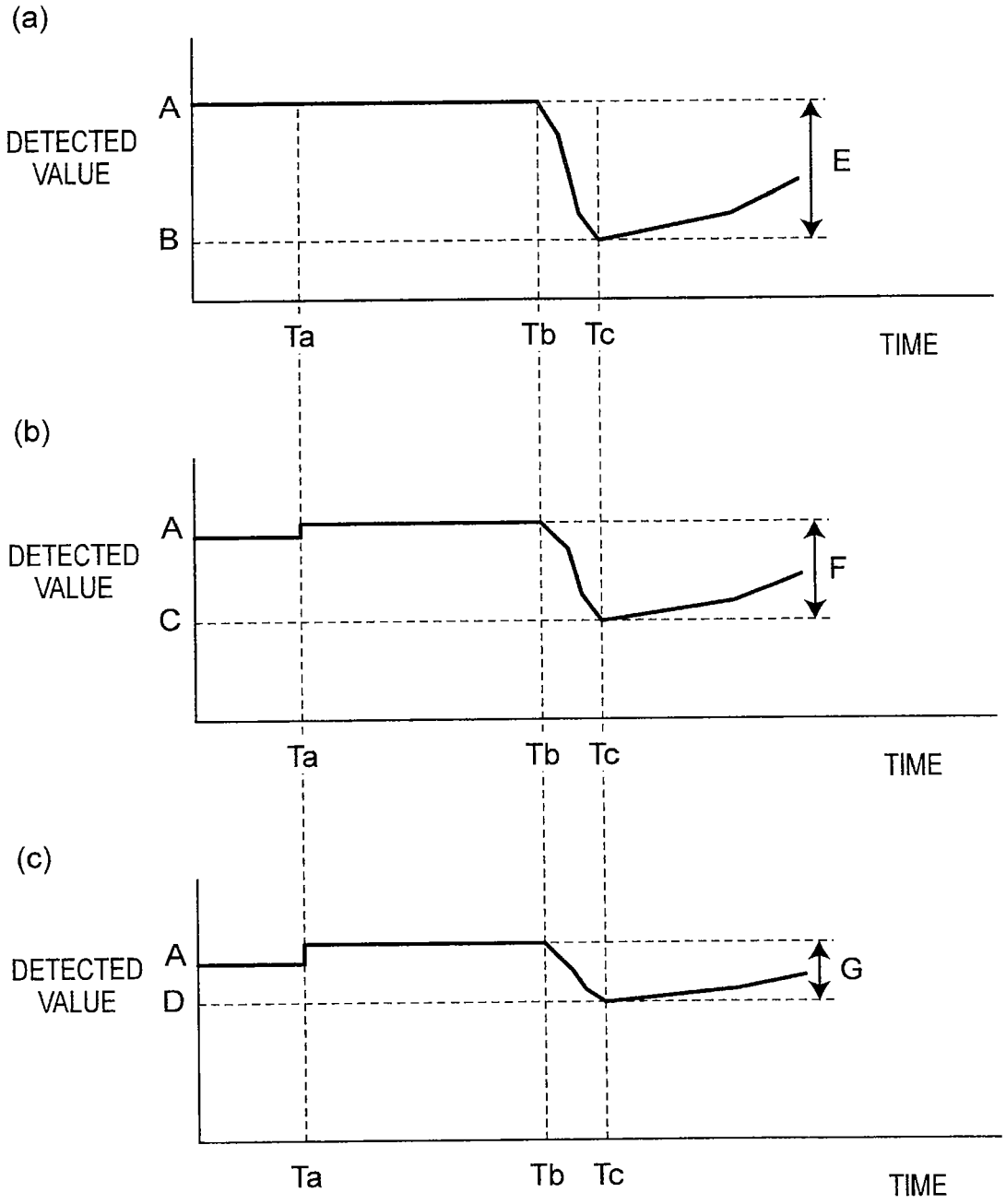
FIGS. 15(*a*)-15(*c*) are diagrams showing an example of detected values at the time of boiling-over in FIG. 14.

FIGS. 15 (*a*) to (*c*) show detection examples of boiling-over. FIG. 15 (*a*) shows the change in the detection value of the electrostatic capacity detector 6 in a state free from effects of the electric field. Before start of heating, the detected value is A. Heating is started at time Ta. At time Tb, boiling-over occurs, and the article to be cooked covers the electrode 5, and the detected value decreases, and the detected value decreases to value B (B<A) at time Tc. The boiling-over article to be cooked gradually moves and covers the electrode 5 in a different manner, and the detected value is elevated gradually. In FIG. 15 (*a*), when boiling-over occurs, the article to be cooked covers the electrode 5, and the electrostatic value is changed, the detected vale of the electrostatic capacity detector 6 is changed from value A to value B. At this time, the change amount is E (=A−B). In other words, the maximum change amount of detected values when boiling-over occurs is value E. Therefore, if there is a change of smaller than change amount E from the value before onset of boiling-over, it is judged that boiling-over has occurred. More specifically, for example, by setting the threshold at E/2, when the detected value of the electrostatic capacity detector 6 becomes smaller than (A−E/2), it is judged that boiling-over has occurred.

FIG. 15 (*b*) shows an example of having a slight effect of the electric field. Before start of heating, the detected value is A, but when heating is started at time Ta, the detected value is elevated slightly as an energy is supplied from the electric field. At time Tb, boiling-over occurs, and the article to be cooked covers the electrode 5, and then the detected value decreases, and further decreases to value C at time Tc. Then the boiling-over article to be cooked gradually moves and covers the electrode 5 in a different manner, and the detected value is elevated gradually. In this case, as boiling-over occurs and the article to be cooked covers the electrode 5, the detected value of the electrostatic capacity detector 6 decreases to value C, and the change amount is F (F<E). In FIG. 15 (*b*), the change amount is the amount of change from start of heating, but it may be expressed as the change amount from detected value A before start of heating. If there is a change less than value F (for example, more than value F/2), it may be judged that boiling-over has occurred.

As compared with the change amount E in FIG. 15 (*a*), the change amount F in FIG. 15 (*b*) is smaller. This is because, in the case of FIG. 15 (*b*), there are effects of the electric field. In the case of the configuration in which the electrostatic capacity detector 6 observes the impedance change due to increase of electrostatic capacity of the electrode 5 by the resistance potential, when boiling-over occurs and the article to be cooked covers the electrode 5, the detected value of the electrostatic capacity detector 6 decreases, but when receiving effects of the electric field, an energy is supplied, and the detected value is elevated. At time Ta, the detected value is elevated only due to the effects of the electric field, but at time Tb, due to effects of the electric field and occurrence of boiling-over, the electrostatic capacity is increased and the detected value is decreased, and due to overlapping of two events, the change amount decreases.

FIG. 15 (*c*) shows a greater effect of the electric field. The change amount is further decreased to become value G (G<F<E). In this case, supposing the threshold value to be E/2 based on FIG. 15 (*a*), the difference is only G in FIG. 15 (*c*), and if E/2>G, boiling-over cannot be detected. In this manner, depending on the receiving degree of effects of the electric field, the change amount of the detected value differs, and the threshold value for detecting occurrence of boiling-over must be adjusted to an optimum value. The receiving level of effects of the electric field varies depending on the wiring length. When the wiring length is longer, effects of the electric field are more likely to be caused, and the change amount in the event of boiling-over becomes smaller. Hence, by determining the threshold value from the relation of the wiring length and the change amount, boiling-over can be detected securely.

In the meantime, when the wiring length differs, the receiving degree of effects of the electric field varies, but similarly when the electrode area differs, the receiving degree of effects of the electric field varies. Therefore, when the area of the plurality of electrodes 5 differs, the threshold value during detecting changes in the electrostatic capacity by the electrostatic capacity detector 6 may be set depending on the electrode area. By determining the threshold value from the relation between the electrode area and the change amount, boiling-over can be detected securely.

Modified Example 2

Figure 16:
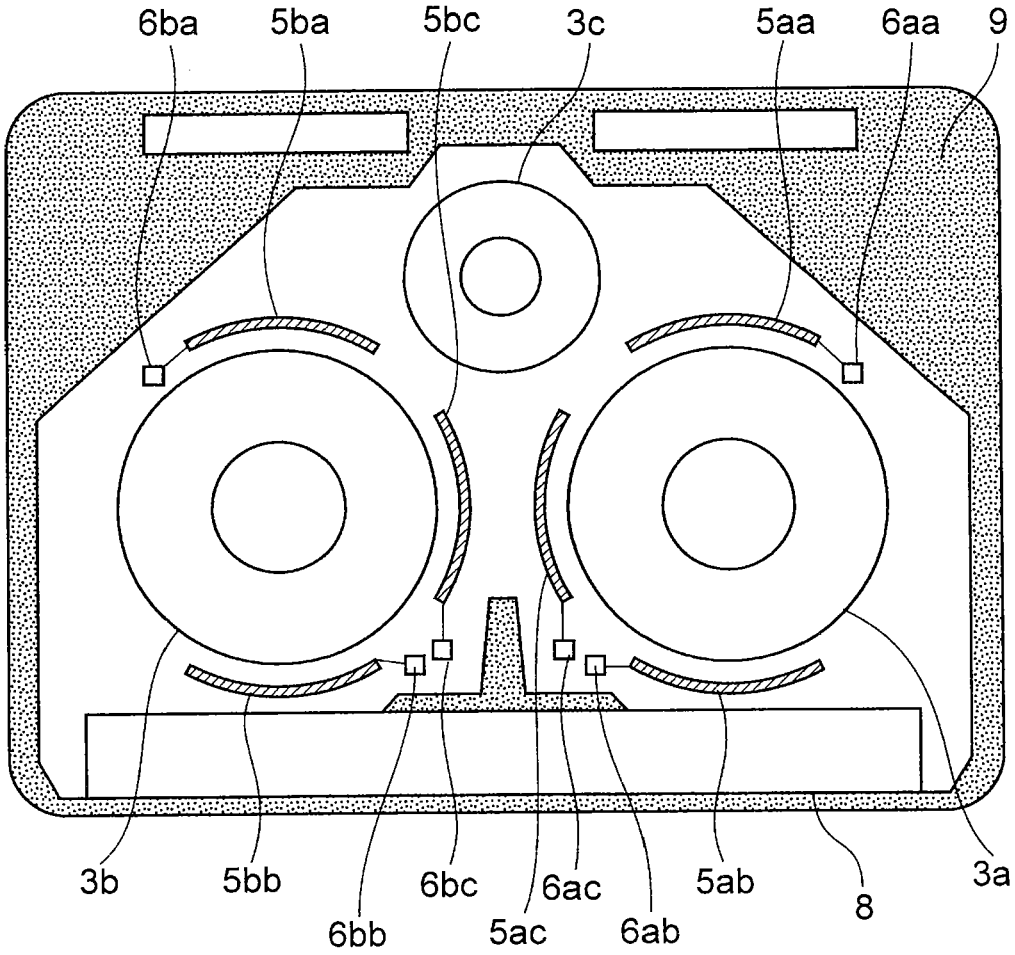
FIG. 16 is a layout diagram in which metal parts are disposed near electrodes in the induction cooking device in preferred embodiment 2 of the present invention.

A metal part may be disposed in the vicinity of the plurality of electrodes 5. FIG. 16 shows an example of layout of a metal part disposed in the vicinity of the electrodes of the induction cooking device. FIG. 16 is a view of the top plate 2 as seen from the back side. When boiling-over occurs and the article to be cooked covers the electrode 5, due to effects of the electric field, the detected value of the electrostatic capacity detector 6 is affected. At this time, if the boiling-over article to be cooked covers a metal part 9, effects of the electric field may be lessened. The metal part 9 is disposed at the back side of the top plate 2. The metal part 9 is disposed on the circumference of the top plate 2, for fixing of the glass or reinforcement of strength. The upper surface of the top plate 2 forming the outer casing of the induction cooking device is smooth and not rough, and it is easy to clean it.

Figure 17:
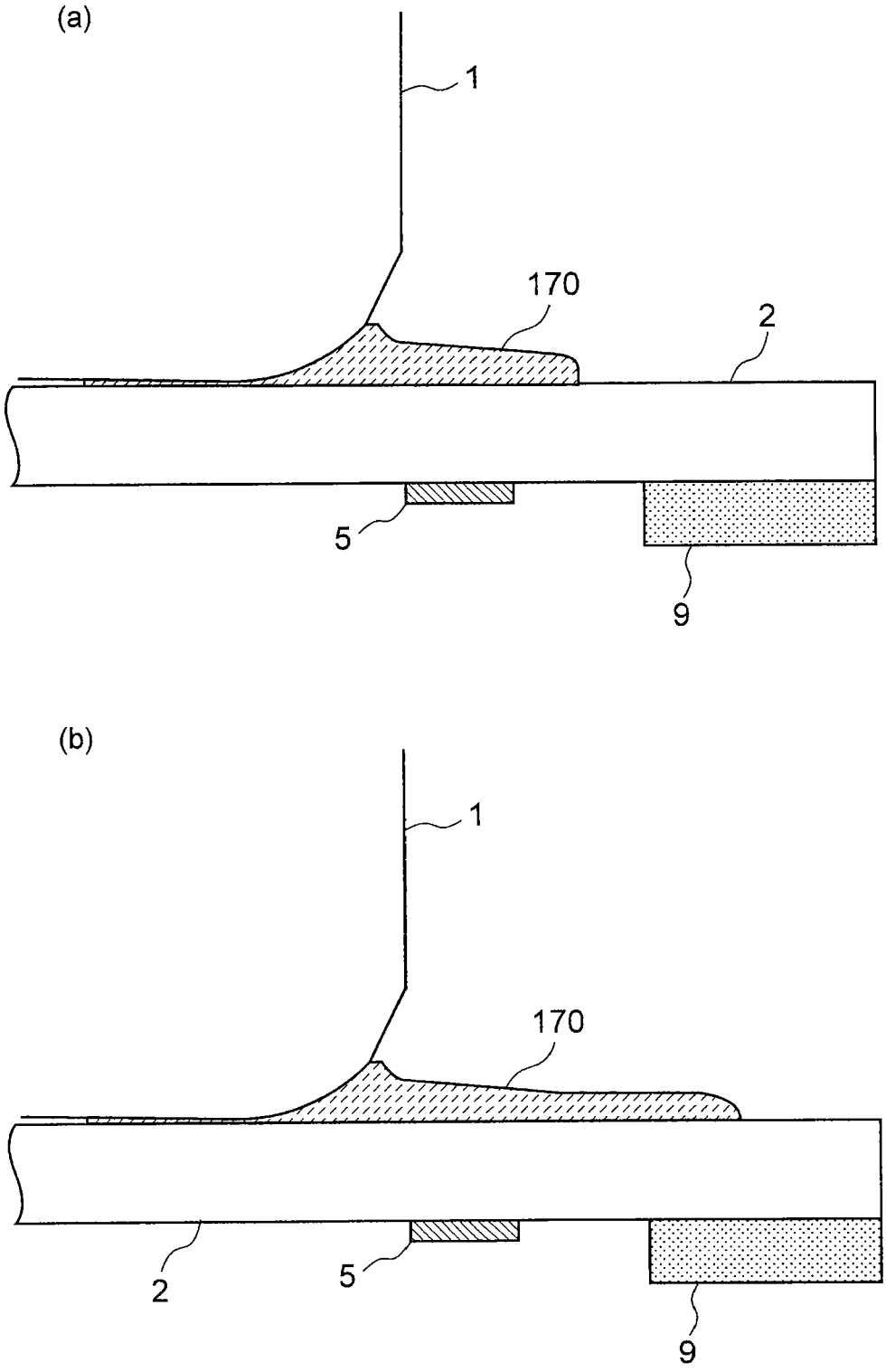
FIGS. 17(*a*) and 17(*b*) are diagrams showing an example of boiling-over in the induction cooking device in preferred embodiment 2 of the present invention.

FIGS. 17 (*a*) and (*b*) show examples of boiling-over of article to be cooked. In FIG. 17 (*a*), the article to be cooked is away from the metal part 9, and in FIG. 17 (*b*), the article to be cooked covers the metal part 9.

In FIG. 17 (*a*), an article to be cooked 170 boiling over from the cooking container 1 covers the electrode 5, and is also linked to the cooking container 1. At this time, a capacitor is formed between the electrode 5 and the boiling-over article to be cooked 170. The electrostatic capacity detector 6 detects the electrostatic capacity of the capacitor. By induction heating, when an electric field is generated, some value by the energy supplied from the electric field is superposed on the detected value of the electrostatic capacity detector 6 by way of the electrode 5, and the change in the electrostatic capacity originally desired to be detected is hardly distinguished. At this time, the degree of effects of the electric field is determined by various factors, such as the electrode area, the wiring length, and distribution of the wiring.

On the other hand, in FIG. 17 (*b*), the boiling-over article to be cooked 170 is also covering the metal part 9. In this case, a capacitor is formed between the electrode 5 and the boiling-over article to be cooked, and also a capacitor is formed between the metal part 9 and the boiling-over article to be cooked 170. These capacitors are connected with each other by the same boiling-over article to be cooked 170. In such a state, when induction heating is started, an electric field is generated, but the energy supplied from the electric field passes through to the side of the metal part 9. As a result, there is no effect on the detected value of the electrostatic capacity detector 6 connected to the electrode 5. Therefore the changes in the electrostatic capacity can be detected without being affected by the electric field, so that boiling-over can be detected accurately.

The advantage by reducing effects of the electric field can be obtained because the boiling-over article to be cooked 170 covers both the electrode 5 and the metal part 9. Hence, it is desired to dispose the metal part 9 near the electrode 5, and more specifically in the case of the plurality of electrodes 5, it is desired that the metal part 9 should be disposed at the same distance from each electrode 5. Hence, the possibilities for the boiling-over article to be cooked 170 to cover above the metal part 9 may be nearly equal on each electrode, and the precision of detection may be equal. The metal part 9 is preferred to be at the same potential as a non-fluctuating stable potential such as the ground of a circuit (for example, the heating control unit 42, or electrostatic capacity detector 6). As a result, different levels of effects of the electric field are not received among the plurality of electrodes 5, and boiling-over can be detected more securely.

In this manner, in the induction cooking device of the preferred embodiment, in order to detect boiling-over, the electrode area or the wiring length is equalized, or the detection threshold value is set differently depending on the electrode area or the wiring length, and boiling-over is detected securely. Hence, boiling-over is prevented from continuing while maintaining the cooking performance. It is also easy to clean. It is hence particularly useful as the induction cooking device used in the general household.

Preferred Embodiment 3

An induction cooking device in this preferred embodiment is characterized by having a plurality of electrodes, and the electrostatic capacity detector is capable of detecting boiling-over securely by judging if boiling-over has occurred or not on the basis of the change in the electrostatic capacity in the plurality of electrodes.

3.1 CONFIGURATION OF INDUCTION COOKING DEVICE

Figure 18:
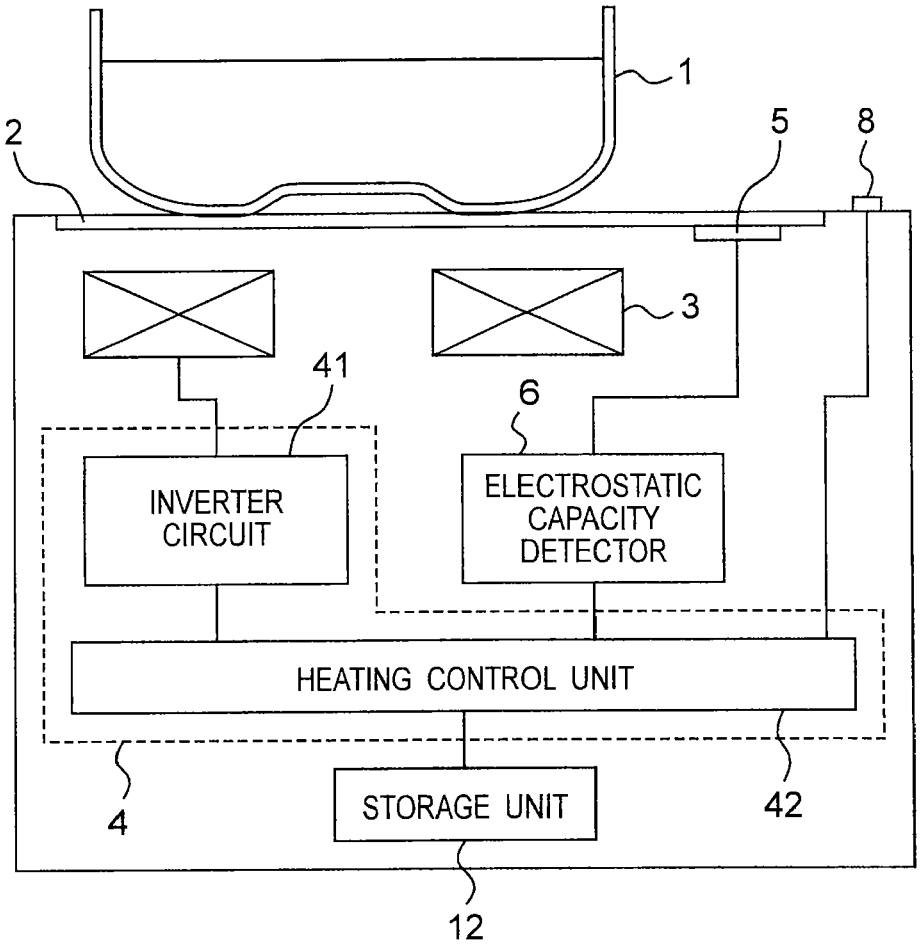
FIG. 18 is a block diagram of an induction cooking device in preferred embodiment 3 of the present invention.

FIG. 18 is a block diagram of an induction cooking device in preferred embodiment 2 of the present invention. In FIG. 18, detailed description is omitted about same component elements as shown in FIG. 10. The electrodes 5 are composed in a thinner shape than the superficial depth determined from the operating frequency when the induction cooking device performs induction heating. By forming the electrodes 5 thinner than the superficial depth, it is effective to suppress generation of eddy current inside of the electrodes 5 due to effects of the magnetic field generated at the time of induction heating of the cooking container 1, thereby suppressing generation of undesired electric field which may disturb detection of changes in the electrostatic capacity due to boiling-over.

Figure 19:
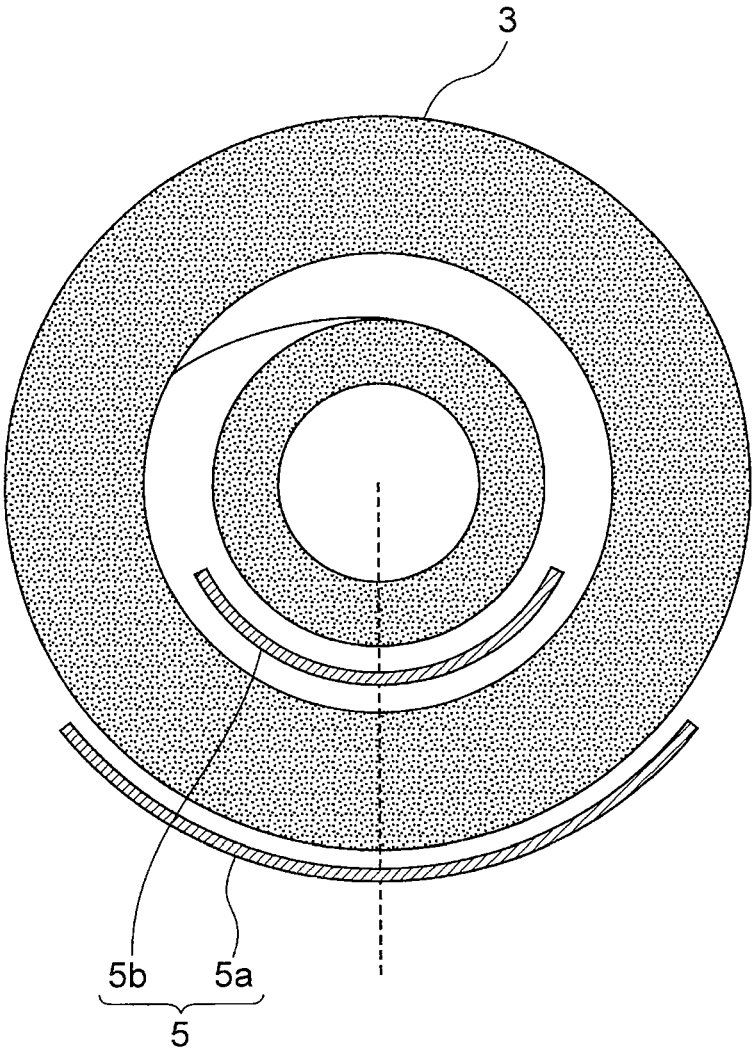
FIG. 19 is a diagram showing a configuration example of electrodes in preferred embodiment 3 of the present invention.

FIG. 19 shows a layout configuration of the electrodes 5 in preferred embodiment 3 of the present invention. As shown in FIG. 19, a heating coil 3 of the preferred embodiment is circular, and wound tightly and loosely, and provided with intermediate gaps. The heating coil 3 is not always required to be circular, but may be elliptical or square. The configuration of the heating coil 3 is not limited by the preferred embodiment.

As shown in FIG. 19, the electrode 5 of the preferred embodiment is composed of an outside electrode 5*a* and an inside electrode 5*b*. More specifically, the electrode 5*b* is provided in a gap of the heating coil 3, and the electrode 5*a* is provided outside of the outer circumference of the heating coil 3. Usually, when the cooking container 1 is placed in the center of the heating coil 3, the article to be cooked boiling over from the cooking container 1 generally spreads widely from the heating coil 3. Therefore, when the heating coil 3 is tightened tightly and loosely, by providing the electrode 5*b* in the gap of the heating coil 3, boiling-over can be detected immediately even in the case of the cooking container 1 of a small diameter. Or by disposing the electrodes 5*a* and 5*b* widely along the edge of the heating coil 3, boiling-over can be detected more easily. In this manner, the electrodes 5 of the preferred embodiment are disposed along the edge of the heating coil 3, and a wide range is covered so that the article to be cooked may cover the electrode if boiling over from any position of the cooking container 1. As a result, boiling-over can be detected immediately.

However, in the case of the configuration shown in FIG. 19, since the electrode 5*b* may be affected by noise due to induction heating, the electrostatic capacity may not be detected correctly. Therefore, the noise preventive means must be reinforced as required. Moreover, when the area of the electrode 5 is increased, effects of a strong electric field may be more likely to be caused, and the area of the electrode 5 cannot be increased too much. On the other hand, in a closed loop structure, effects of a strong electric field are intensified, which is not desired. Hence, in order to compose the electrodes 5 in a smaller area and in order to detect boiling-over in a wider range, it is preferred to be disposed along the edge of the heating coil 3.

3.2 OPERATION OF INDUCTION COOKING DEVICE

In the induction cooking device having such configuration, the operation is explained below. When the user manipulates the operation unit 8 and instructs to start heating, the heating control unit 42 operates the inverter circuit 41, and supplies a high-frequency current to the heating coil 3. As a result, a high-frequency magnetic field is generated from the heating coil 3, and heating of the cooking container 1 is started.

The heating control unit 42 controls the inverter circuit 41 so as to attain the power determined by the user by manipulating the operation unit 8. More specifically, for example, the input current of the inverter circuit 41 is detected, and the detected value is put into the heating control unit 42. The heating control unit 42 compares the power determined by the user with the input current of the inverter circuit 41, and changes the operating state of the inverter circuit 41. The heating control unit 42 repeats such operation, and controls to attain the power determined by the user, and operates to maintain the power.

While heating the cooking container 1, when the article to be cooked in the cooking container 1 reaches the boiling point, the article to be cooked may boil over the cooking container 1. At this time, if heating is continued without decreasing the heating power, the article to be cooked gradually boils over from the cooking container 1, and various problems occur. For example, if the article to be cooked boils over on the operation unit 8, the operation unit 8 becomes too hot to be manipulated. If the boiling-over article to be cooked covers the air intake and exhaust port of the induction cooking device, it is hard to clean it. The article to be cooked boiling over from the cooking container 1 covers the top plate 2, and is further heated, and it may be stuck hard on the top plate 2.

Accordingly, in the preferred embodiment, when the electrostatic capacity detector 6 detects a change in the electrostatic capacity, the heating control unit 42 decreases the heating power or stop heating, and prevents boiling-over continuing. As a result, for example, the article to be cooked is not stuck to the top plate 2.

In the preferred embodiment, in particular, when the electrostatic capacity detector 6 detects changes in the electrostatic capacity in the plurality of electrodes 5*a* and 5*b*, it judges that the boiling-over has occurred, and the heating control unit 42 controls to decrease or stop the heating power.

If the article to be cooked boils over, it is not predicted boiling-over occurs from which point of the cooking container 1. Therefore, when the electrodes 5 are provided to surround the outer circumference along the edge of the heating coil 3, possibility of the article to be cooked boiling over and covering the electrode 5 is heightened. But when the electrodes 5 are provided to surround all of the outer circumference of the heating coil 3, the area of the heating coil 3 is increased, and effects of a strong electric field are more likely to be received. Therefore, the electrodes 5 should not be provided to surround the outer circumference. Therefore, the electrode 5 should not be disposed in a very wide area. On the other hand, if the electrode 5 is provided in a small area, for example, if the article to be cooked happens to pop up in a frying process and drops on the electrode 5, the electrostatic capacity is changed, and it may be falsely detected as boiling-over, and the heating power is decreased, and the cooking performance may be lowered. Thus, if the area of the electrode is small, it is hard to judge whether boiling-over has occurred or not in the case of a change in the electrostatic capacity.

In the preferred embodiment, therefore, a plurality of electrodes 5*a* and 5*b* are disposed, and the electrostatic capacity detector 6 detects changes in the electrostatic capacity in the plurality of electrodes, and when boiling-over is detected correctly, the heating power is decreased, and it is controlled to prevent boiling-over. As a result, the boiling-over amount of the article to be cooked is decreased, and the article to be cooked is prevented from sticking to the top plate 2 to make cleaning difficult.

3.3 SUMMARY

As described herein, the induction cooking device of the present embodiment has a plurality of electrodes 5*a* and 5*b* disposed, and judges occurrence of boiling-over when the electrostatic capacity detector 6 detects changes in the electrostatic capacity in the plurality of electrodes 5*a* and 5*b*, and thereby unfailingly detects boiling-over while preventing detection errors. In the preferred embodiment, two electrodes are provided, but three or more electrodes may be provided, and when changes in the electrostatic capacity are detected in two or more electrodes, occurrence of boiling-over may be detected.

In this preferred embodiment, the heating coil 3 is circular, and the electrodes 5 are disposed along the edge of the heating coil 3. Therefore, the electrodes 5 are formed in a fan-like arc shape. This arc shape has the length in the radial direction shorter than the length in the arc direction, so that boiling-over can be detected in a wider range without increasing the area so much. Hence, boiling-over can be detected more quickly and secure.

In the meantime, if the diameter of the cooking container 1 is changed, it may take a longer time until the boiling-over article to be cooked spreads to reach the electrodes 5. In the preferred embodiment, however, the plurality of electrodes 5, 5*b* are disposed at different distances from the center of the heating coil 3. Therefore, if the cooking container 1 of a different diameter is used, boiling-over can be detected earlier.

3.4 MODIFIED EXAMPLES

Modified Example 1

The heating control unit 42 may change the mode of control between when the change in the electrostatic capacity is detected in the plurality of electrodes 5*a* and 5*b* by the electrostatic capacity detector 6, and when the change in the electrostatic capacity is detected in one electrode. When the electrostatic capacity is changed in the plurality of electrodes, occurrence of boiling-over may be detected securely. However, if heating is continued without decreasing the heating power until changes in the electrostatic capacity are detected in the plurality of electrodes, the boiling-over amount of the article to be cooked may be increased. Therefore, it may be judged that the probability of occurrence of boiling-over is high when changes in the electrostatic capacity are detected in the plurality of electrodes, and that the possibility of boiling-over is present when changes in the electrostatic capacity are detected in one electrode, and thereby the heating control unit 42 controls differently depending on the situation, so that it is preferable that the boiling-over amount may be decreased.

For example, when the electrostatic capacity detector 6 detects changes in the electrostatic capacity in the plurality of electrodes 5, the decreasing amount of heating power may be increased more than when changes in the electrostatic capacity are detected in one electrode 5. As a result, the heating power is decreased more when the probability of boiling-over is higher, and boiling-over can be suppressed more securely. When changes in the electrostatic capacity are detected in one electrode, there is a possibility of boiling-over, and the heating power is decreased, and the boiling-over speed can be suppressed. The number of electrodes is not limited to two, but three or more electrodes may be provided. When changes in the electrostatic capacity are detected in two or more electrodes, the decreasing amount of heating power may be increased more than when changes in the electrostatic capacity are detected in one electrode only.

Modified Example 2

The electrostatic capacity detector 6 first detects changes in the electrostatic capacity of the electrode 5*b* closer to the center of the heating coil 3, and later detects changes in the electrostatic capacity in the electrode 5*a* remoter from the center of the heating coil 3, and in this case it may be judged that boiling-over has occurred. At this time, the heating control unit 42 may decrease or stop the heating power. If the diameter of the cooking container 1 is small, the boiling-over article to be cooked may overflow from the edge of the cooking container 1, and spreads widely to the outer side. Accordingly, as shown in FIG. 19, when a plurality of electrodes 5*a* and 5*b* are disposed at different distances from the center of the heating coil 3, the article to be cooked first covers the electrode 5*b* closer to the center of the heating coil 3, and then covers the other electrode 5*a*. Therefore, when changes in the electrostatic capacity are not detected in the sequence of the electrode 5*b* and then the electrode 5*a*, it is possible that other phenomenon than boiling-over has occurred, and the heating control unit 42 controls not to decrease or stop the heating power. As a result, false detection of boiling-over can be prevented.

Incidentally, when the detection interval of changes in the electrostatic capacity is long between the electrode 5*b* and the electrode 5*a*, for example, even if the sequence of detection is similar to the case of boiling-over, it is possible that the electrostatic capacity is changed due to other cause than boiling-over. For example, if the interval is more than 5 seconds, it is considered that other situation than continuous boiling-over is taking place. Therefore, after detection of a change in the electrostatic capacity in the inside electrode 5*b*, only when a change in the electrostatic capacity in the outside electrode 5*a* is detected within a specified time (for example, within 5 seconds); it may be preferably judged that the boiling-over has taken place. A preferred duration of the specified time varies with the structure or layout of the electrodes, and it is preferred to determine the specified time experimentally by causing a continuous boiling-over.

Modified Example 3

Figure 20:
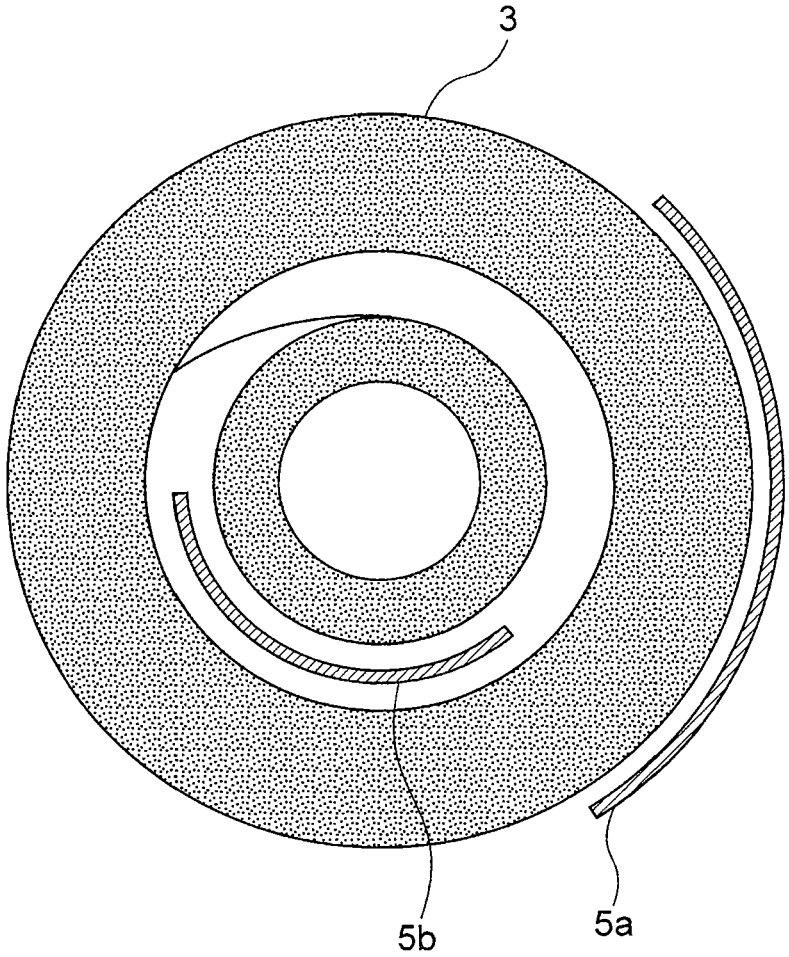
FIG. 20 is a diagram showing other configuration example of electrodes in preferred embodiment 3 of the present invention.

The electrodes 5*a* and 5*b* may be deviated and disposed, as shown in FIG. 20, so that the centers of the edge directions of the both electrodes may not to be aligned straightly from the center of the heating coil 3. Generally, when the article to be cooked boils over from the cooking container 1, it cannot be predicted from which direction the boiling-over occurs. Accordingly, in order to detect securely regardless of the occurrence direction of boiling-over, the plurality of the electrodes 5*a* and 5*a* are deviated and disposed so that the centers of the electrodes may not be aligned straightly, whichever the direction of occurrence may be, boiling-over can be detected at a higher possibility. As a result, the detection precision of boiling is enhanced.

Modified Example 4

As shown in FIG. 18, the induction cooking device may be further provided with a storage unit 12 for storing specified values of the electrostatic capacity. The specified value may be one or more. The storage unit 12 may be a programmable memory such as flash memory, or a fixed memory. The storage unit 12 may be also a part of the heating control unit 42. For example, the storage unit 12 may be a ROM region or a flash region of the heating control unit 42 such as microcomputer or DSP.

In this case, the induction cooking device compares the set value stored in the storage unit 12 with the change amount of the electrostatic capacity detected by the electrostatic capacity detector 6, and changes the mode of control of the heating control unit 42 depending on the result of comparison. The electrostatic capacity of the electrode 5 varies with the specific inductive capacity of the article to be cooked covering the electrode 5 or the covering area above the electrode. In particular, the difference in the covering area above the electrode 5 is closely related with the boiling-over amount of the article to be cooked, and it is important information for control after detection. When the electrode 5 is covered with the article to be cooked in a wide area, the change in the electrostatic capacity is large, and the covering area above the electrode 5 is small, the change in the electrostatic capacity is small, and the boiling-over amount of the article to be cooked may be estimated from the change amount of the electrostatic capacity.

The heating control unit 42 compares the change amount of the electrostatic capacity detected by the electrostatic capacity detector 6, with the specified value stored in the storage unit 12 which is connected to the heating control unit 42, and determines the mode of control. For example, when the change in the electrostatic capacity is larger than the specified value, heating is stopped, and when the change in the electrostatic capacity is smaller than the specified value, the heating power is decreased. Specifically, when the change in the electrostatic capacity is large, it is estimated that the boiling-over amount of the article to be cooked is large, and heating is stopped in order to stop the boiling-over quickly. On the other hand, when the change in the electrostatic capacity is small, it is estimated that the boiling-over amount of the article to be cooked is small, and it is possible to stop the boiling-over only by slightly decreasing the heating power. If the heating power is decreased more than necessary, the power becomes weak when cooking while maintaining a boiling state, and the cooking performance may be lowered, and therefore it is preferred to keep the decreasing rate of the heating power to a minimum limit so as not to allow the boiling-over to continue. In this manner, by determining the decreasing amount of the heating power depending on the boiling-over amount of the article to be cooked, the boiling-over may be suppressed to a minimum limit without lowering the cooking performance. As a result, a clean and easy-to-use induction cooking device may be realized.

Modified Example 5

Figure 21:
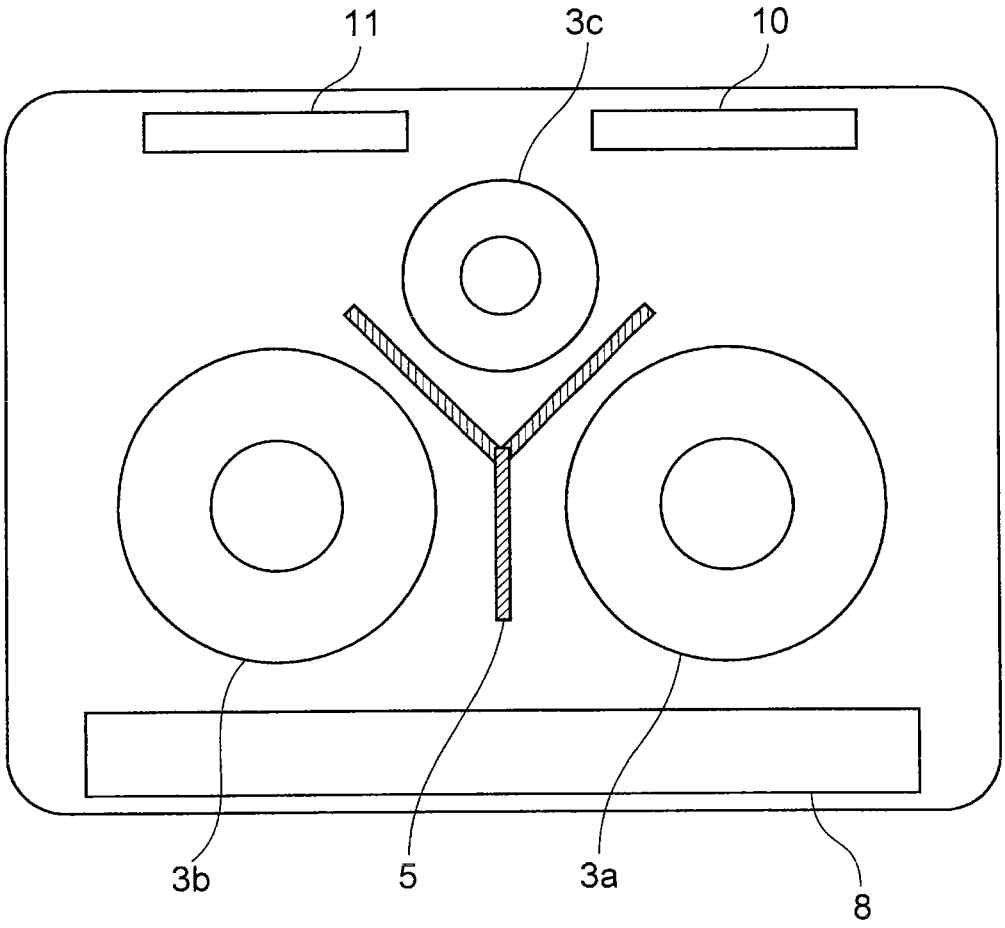
FIG. 21 is a diagram showing another configuration example of electrodes in preferred embodiment 3 of the present invention.

As shown in FIG. 21, the electrodes 5 may be disposed between each two of the heating coils 3*a*, 3*b*, and 3*c*. The induction cooking device has one heating coil or a plurality of heating coils. The induction cooking device shown in FIG. 21 has three heating ports, and in all three heating ports, induction heating is conducted by the heating coils 3*a*, 3*b*, and 3*c*. The heating port located at the most separate place from the operation unit 8 is a radiant heater, which is a most popular type. In this example, all heating ports are explained as induction heating type, but other heating types may be also included.

When boiling-over occurs, the article to be cooked spreads from the cooking container 1, and may further spread widely to other heating port. In other heating port, other material may be cooked, and if the temperature of the top plate 2 is high, the boiling-over article to be cooked may stick hard to the top plate 2, and it may be difficult to clean. To avoid such circumstance, the electrodes 5 are disposed between each two of the heating coils 3*a*, 3*b*, and 3*c*, so that the boiling-over article to be cooked may be prevented from spreading to a next heating port. Further, when the electrodes 5 disposed between each two of the heating coils 3*a*, 3*b*, and 3*c* are mutually connected as shown in FIG. 21, or composed of one electrode only, only one electrostatic capacity detector 6 is needed, and an inexpensive configuration may be realized.

Modified Example 6

Figure 22:
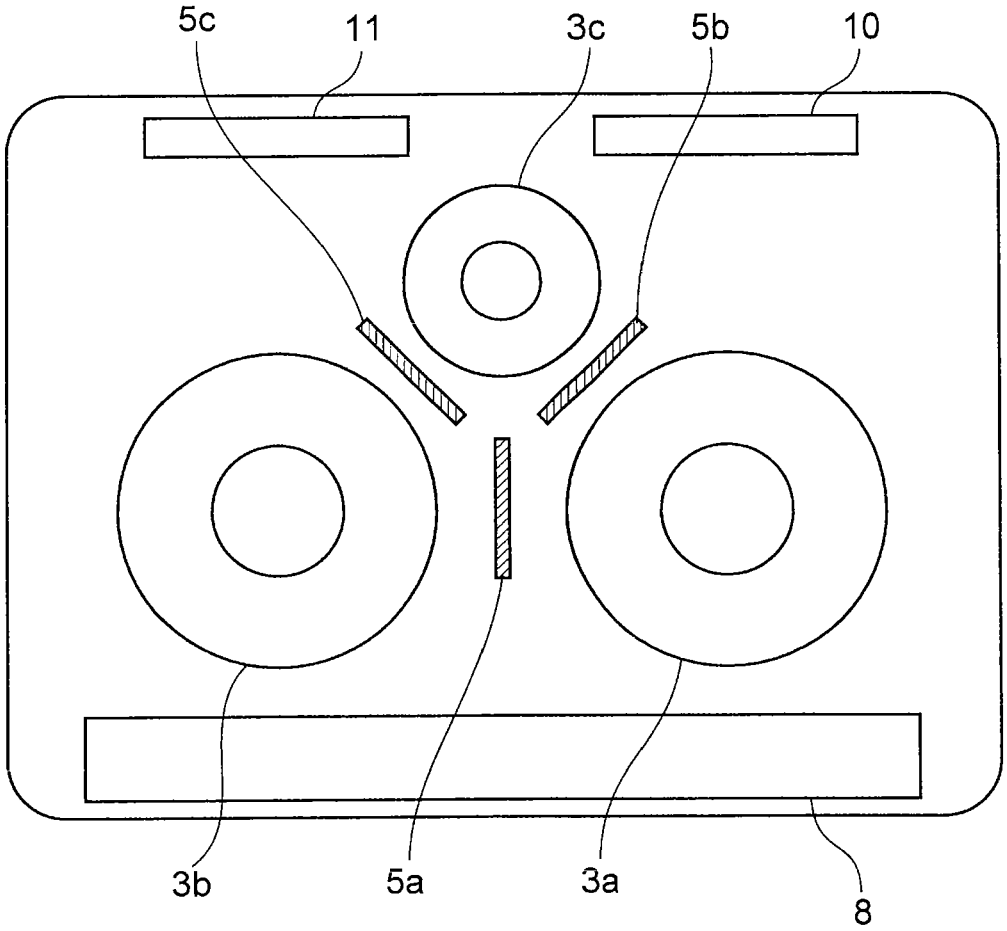
FIG. 22 is a diagram showing a different configuration example of electrodes in preferred embodiment 3 of the present invention.

In modified example 5, the electrodes 5 disposed for the plurality of heating coils 3*a*, 3*b*, and 3*c* are composed of one electrode only, but as shown in FIG. 22, they may be composed of separate electrodes. That is, the electrodes 5*a*, 5*b*, and 5*c* may be individually disposed among the heating coils 3*a*, 3*b*, and 3*c*. When the electrode area is increased, the electrodes receives effects of a strong electric field more easily, and the electrostatic capacity cannot be detected correctly. However, as shown in FIG. 22, by disposing the individual electrodes 5*a*, 5*b*, and 5*c* among the respective heating coils 3*a*, 3*b*, 3*c*, the area of each one of the electrodes 5*a*, 5*b*, and 5*c* can be decreased. Therefore it is less likely to receive effects of noise of a strong electric field, and the boiling-over amount of the article to be cooked may be detected more correctly. In this case, the electrostatic capacity detector 6 detects the change in the electrostatic capacity of the three electrodes 5*a*, 5*b*, and 5*c* individually. Hence, it can be predicted easily from which heating port the article to be cooked has boiled over.

Modified Example 7

Figure 23:
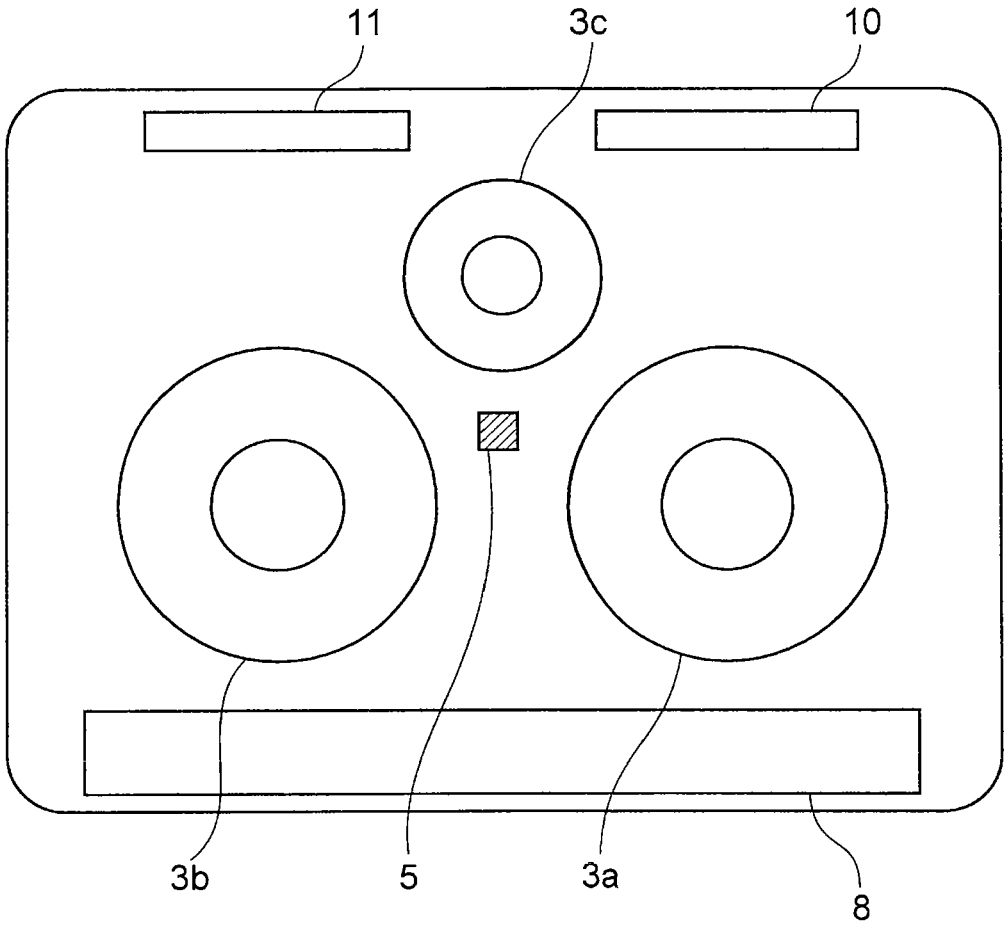
FIG. 23 is a diagram showing other different configuration example of electrodes in preferred embodiment 3 of the present invention.

As shown in FIG. 23, one electrode 5 may be disposed nearly in the center of the plurality of heating coils 3*a*, 3*b*, and 3*c*. In the induction cooking device having a plurality of heating ports, in an electrode area of as small as possible, in order to have the number of electrodes same as the number of electrostatic capacity detectors 6 (for example, one), as shown in FIG. 23, the electrodes 5 should be disposed at a shortest distance from the outer circumference of the heating coils 3*a*, 3*b*, and 3*c*. As a result, the articles to be cooked boiling over from the individual heating ports can be detected.

In this case, however, since the distance from the center of the heating coils 3*a*, 3*b*, and 3*c* to the electrode 5 is long, if the cooking container 1 is small in diameter, it is not possible to detect until the boiling-over article to be cooked spreads sufficiently. That is, it takes relatively long time to, even after an occurrence of boiling-over, detect it. Accordingly, in order to detect boiling-over earlier, the configuration shown in FIG. 21 or FIG. 22 is more preferable. On the other hand, the electrode 5 shown in FIG. 23 may be realized at a lowest cost.

Therefore, the configuration of the electrode 5 may be selected by considering which is more important, whether the cost and ease of realization, or the accuracy of detection of boiling-over and the quickness to detect.

Modified Example 8

Figure 24:
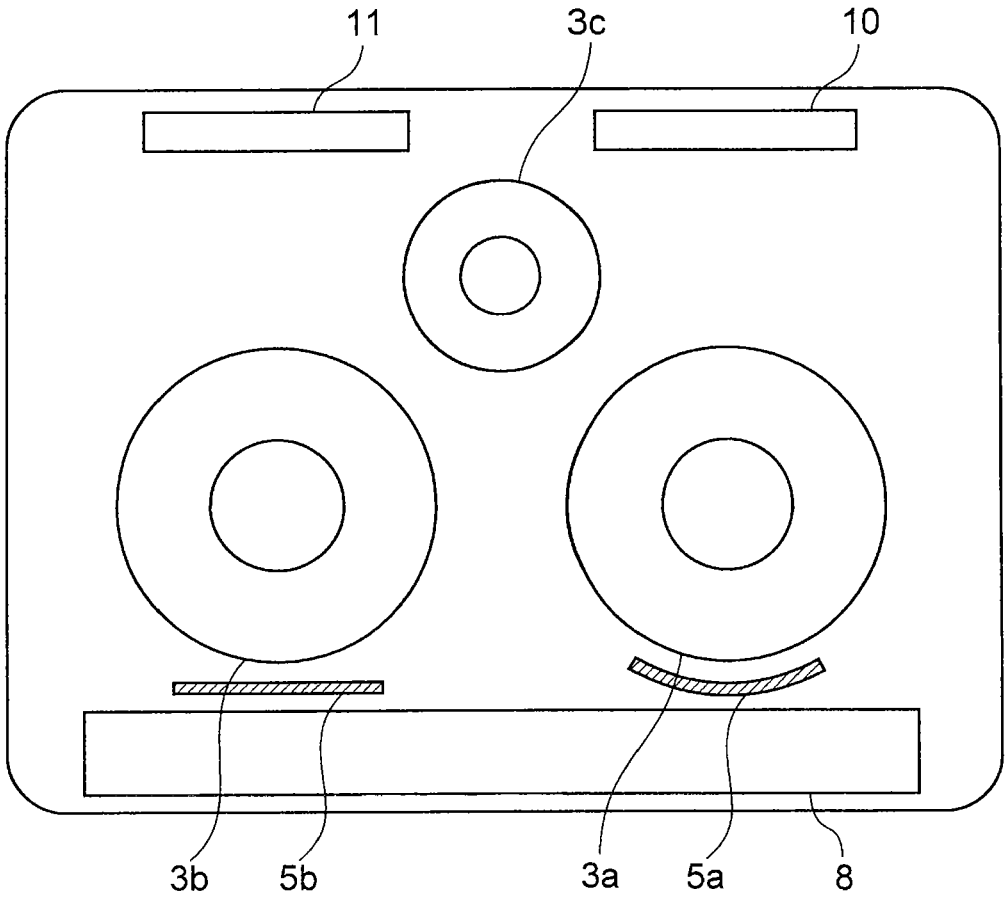
FIG. 24 is a diagram showing another different configuration example of electrodes in preferred embodiment 3 of the present invention.

As shown in FIG. 24, the electrodes 5*a* and 5*b* may be disposed between the operation unit 8 manipulated by the user for instructing the heating state, and the center of the heating coils 3*a* and 3*b*.

The operation unit 8 of the induction cooking device is often disposed on the front panel of the device, or on the top plate 2 on the upper surface of the device. When disposed on the top plate 2, it is roughly divided into two cases, whether a frame for supporting the top plate 2 disposed between the operation unit 8 and the top plate 2, or an electrode is disposed on the lower surface of the top plate 2 and the operation unit 8 makes use of the change in the electrostatic capacity. Where the frame is provided, since a step difference is formed, the article to be cooked boiling over the cooking container 1 rarely covers the operation unit 8. In the case of the operation unit 8 for making use of the change in the electrostatic capacity by disposing the electrode on the lower surface of the top plate 2, since there is no step difference from the top plate 2, the boiling-over article to be cooked may possibly cover the electrode 8. In such a case, since the boiling-over article to be cooked is hot, if attempted to manipulate the operation unit 8 in order to decrease the heating power, or to stop the heating operation, it is not possible to manipulate because of the presence of the hot article to be cooked, or burns or injuries may be caused.

To avoid such trouble, as shown in FIG. 24, by disposing the electrodes 5*a* and 5*b* between the center of the heating coil 3 and the operation unit 8, the heating control unit 42 decreases the heating power so that the boiling-over article to be cooked may not cover the operation unit 8, and the induction cooking device to be used safely may be realized. Preferably, the electrodes 5*a* and 5*b* should be disposed between the edge of the heating coil 3 and the operation unit 8, but the configuration is not limited to it.

The electrode 5 may be either the electrode 5*a* which is disposed along the edge of the heating coil 3, or the electrode 5*b* which is disposed on a straight line.

Modified Example 9

In the case of the induction cooking device having an intake port and an exhaust port, the electrodes may be disposed so that the boiling-over article to be cooked may not enter and cover the exhaust port or the intake port.

The induction cooking device is often cooled in order to prevent breakdown of the device because heat is generated by the inverter circuit 41 or the heating coils 3*a* and 3*b* provided inside the device. Usually, the cooling method is air cooling by sending air into the heating parts through a cooling fan. In this case, it requires an intake port for taking in fresh air from outside by the cooling fan, and an exhaust port for discharging the heated air after cooling the device to the outside. In such a case, the boiling-over article to be cooked may enter and cover the intake port or exhaust port. However, it is not easy to clean the contaminated intake port or the exhaust port, and it is required to prevent the boiling-over article to be cooked from entering.

Figure 25:
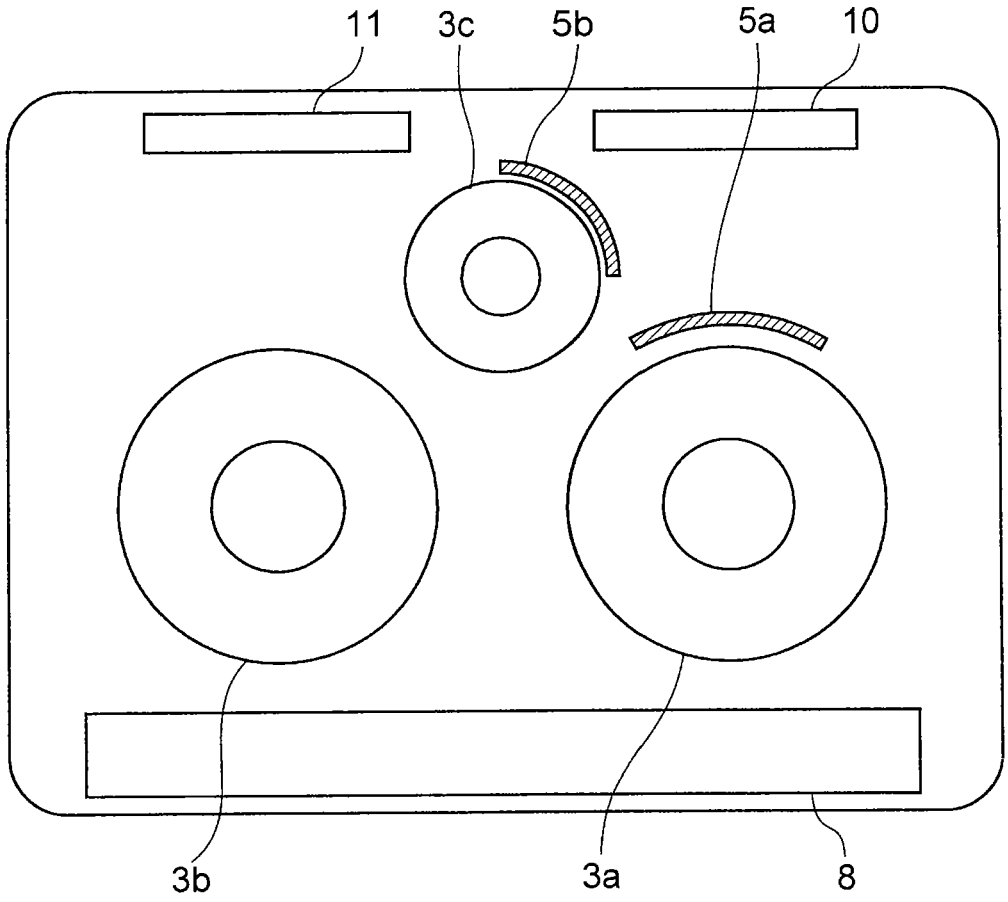
FIG. 25 is a diagram showing a further different configuration example of electrodes in preferred embodiment 3 of the present invention.
Figure 26:
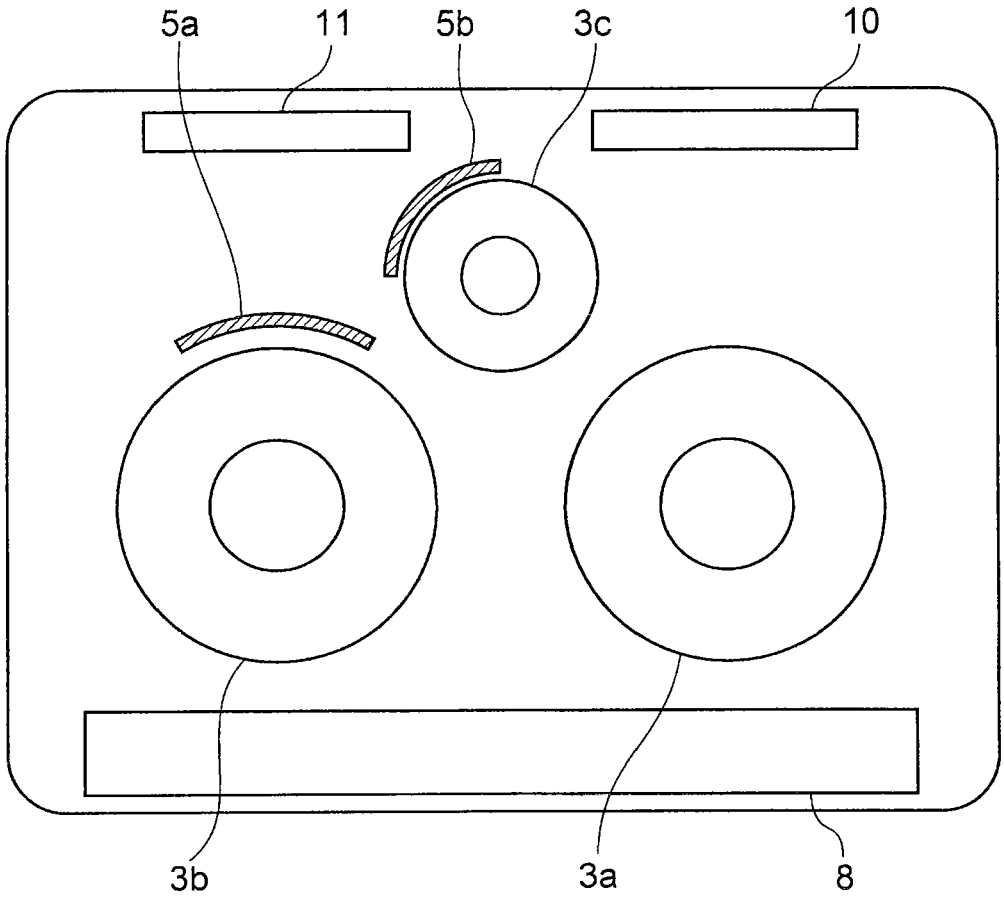
FIG. 26 is a diagram showing a still further different configuration example of electrodes in preferred embodiment 3 of the present invention.

Hence, as shown in FIG. 25, the electrodes 5*a* and 5*b* may be disposed between the center of the heating coils 3*a* and 3*c* and an intake port 10. Or, as shown in FIG. 26, the electrodes 5*a* and 5*b* may be disposed between the center of the heating coils 3*b* and 3*c* and an exhaust port 11. Accordingly, the boiling-over can be detected, and by decreasing the heating power by the heating control unit 42, entry of the article to be cooked into the intake port 10 or the exhaust port 11 may be prevented. In the meantime, it is preferable that the electrodes 5*a* and 5*b* should be disposed between the edge of the heating coil 3 and the intake port 10 or the exhaust port 11, but the configuration is not limited to it.

As explained herein, the induction cooking device of the preferred embodiments has the electrodes disposed appropriately so as not to disturb manipulation of the device or cleaning thereof. Therefore, the boiling-over article to be cooked can be detected securely, and the heating power can be controlled depending on the boiling-over amount of the article to be cooked. Hence, while maintaining the cooking performance, boiling-over is prevented from continuing, and cleaning is easier. The induction cooking device of the preferred embodiments is very used as an induction cooking device useful in a general household.

The configurations and controls disclosed in preferred embodiments 1 to 3 may be arbitrarily and freely combined and used.

INDUSTRIAL APPLICABILITY

According to the induction cooking device of the present invention, it brings about outstanding effects of detecting boiling-over while reducing effects of induction heating, and it is very useful as an induction cooking device to be used and installed in a general household, office, or restaurant.

The invention claimed is:

1. An induction cooking device comprising:

a top plate on which a cooking container is placed, a heating coil, the outer circumference of which is nearly circular, for generating an induction magnetic field for heating the cooking container, a heating control unit for controlling a heating power of the cooking container by controlling a high-frequency current to be supplied to the heating coil, an electrode disposed in a lower surface of the top plate, and an electrostatic capacity detector for detecting changes in electrostatic capacity occurring in the electrode when articles to be cooked contact with the top plate, wherein when the electrostatic capacity detector senses changes in the electrostatic capacity of the electrode, the heating control unit decreases or stops the heating power of the cooking container, and the electrode having an arc shape and being concentrically disposed outside of the outer circumference of the heating coil and along the edge of the heating coil.

2. The induction cooking device according to claim 1, wherein as to the electrode, a length in the radial direction is shorter than a length in the arc direction.

3. The induction cooking device according to claim 1, wherein the electrode is a plurality of electrodes having a same area, and the length of a wiring connecting between the electrodes and the electrostatic capacity detector equalizes an electrostatic capacity of the plurality of electrodes.

4. The induction cooking device according to claim 1, wherein the electrode is formed by printing a conductive material on the top plate.

5. The induction cooking device according to claim 1, wherein wiring for connecting between the electrode and the electrostatic capacity detector is formed by printing a conductive material on the top plate.

6. The induction cooking device according to claim 1, wherein the electrode is electrode is provided in a plurality, and metal parts are also disposed near the plurality of electrodes.

7. The induction cooking device according to claim 6, wherein a distance between the metal parts and the electrode is equal.

8. The induction cooking device according to claim 6, wherein the metal parts are connected to a specified potential same as in the heating control unit or the electrostatic capacity detector.

9. The induction cooking device according to claim 1, wherein the heating coil comprises a plurality of heating coils, and the electrode is disposed among the plurality of heating coils.

10. The induction cooking device according to claim 1, wherein both the electrode and the heating coil are provided in a plurality, and each electrode is disposed among the plurality of heating coils.

11. The induction cooking device according to claim 1, wherein the heating coil comprises a plurality of heating coils are provided, and the electrode is disposed nearly in the center of the plurality of heating coils.

12. The induction cooking device according to claim 1, further comprising an operation unit to be manipulated by the user for indicating a heating state, wherein the electrode is disposed between the center of the heating coil and the operation unit.

13. The induction cooking device according to claim 1, wherein the electrode comprises a plurality of electrodes, and the heating control unit decreases or stops the heating power of the cooking container only when the electrostatic capacity detector first detects a change in electrostatic capacity in a first electrode closer to the center of the heating coil, and then detects a change in electrostatic capacity in a second electrode positioned further from the center of the heating coil than the first electrode.

14. The induction cooking device according to claim 13, wherein the electrode comprises a plurality of electrodes, and the heating control unit decreases or stops the heating power of the cooking container only when the electrostatic capacity detector detects a change in electrostatic capacity in a first electrode closer to the center of the heating coil, and then detects, within a prescribed time, a change in electrostatic capacity in a second electrode positioned further from the center of the heating coil than the first electrode.

15. The induction cooking device according to claim 1, wherein the electrode comprises a plurality of electrodes, and the heating control unit decreases or stops the heating power of the cooking container only when the electrostatic capacity detector detects a change in electrostatic capacity in the electrodes.

16. The induction cooking device according to claim 1, wherein the electrode having the arc shape is entirely disposed outside of the outer circumference of the heating coil and along the edge of the heating coil.

17. The induction cooking device according to claim 1, wherein the arc shape is aligned in a same plane with the heating coil to circumferentially border a periphery of the edge of the heating coil.

18. An induction cooking device comprising:

a top plate formed to receive a cooking container on a first surface of the top plate;

a heating coil adjacent a second surface of the top plate opposite the first surface, the heating coil having a nearly circular outer circumference and formed to generate an induction magnetic field to heat the cooking container, an electrode disposed adjacent the second surface and entirely outside the outer circumference of the heating coil, the electrode formed as an arc shape to circumferentially border at least part of the outer circumference of the heating coil; and an electrostatic capacity detector operable to sense changes in electrostatic capacity of the electrode when articles to be cooked contact the first surface of the top plate.

19. The induction cooking device according to claim 18, wherein the electrode is positioned to concentrically align the arc shape with the nearly circular outer circumference of the heating coil.

* * * * *